US005990449A

United States Patent [19]

Sugiyama et al.

[11] Patent Number: 5,990,449

[45] Date of Patent: Nov. 23, 1999

[54] ELECTRIC HEATING DEVICE FOR MIRROR

[75] Inventors: Tetsuya Sugiyama, Soka; Makoto Nagaoka, Kiyose; Yoshiya Ueda; Hiroshi Tazunoki, both of Soka, all of Japan

[73] Assignee: Pentel Kabushiki Kaisha, Japan

[21] Appl. No.: 08/492,083

[22] PCT Filed: Nov. 2, 1994

[86] PCT No.: PCT/JP94/01848

§ 371 Date: Jun. 29, 1995

§ 102(e) Date: Jun. 29, 1995

[87] PCT Pub. No.: WO95/12508

PCT Pub. Date: May 11, 1995

[30] Foreign Application Priority Data

| | | | |
|---|---|---|---|
| Nov. 4, 1993 | [JP] | Japan | 5-063927 |
| Dec. 2, 1993 | [JP] | Japan | 5-338954 |
| Feb. 8, 1994 | [JP] | Japan | 6-035415 |
| Mar. 25, 1994 | [JP] | Japan | 6-103475 |
| Apr. 7, 1994 | [JP] | Japan | 6-095812 |
| Apr. 7, 1994 | [JP] | Japan | 6-095813 |
| Aug. 10, 1994 | [JP] | Japan | 6-209101 |
| Aug. 25, 1994 | [JP] | Japan | 6-224266 |
| Sep. 12, 1994 | [JP] | Japan | 6-243283 |

[51] Int. Cl.[6] ..... H05B 1/00

[52] U.S. Cl. ..... 219/219

[58] Field of Search ..... 219/202–203, 219/219, 522, 543; 359/838, 841, 850, 267; 338/306–309; 392/438, 439

[56] References Cited

U.S. PATENT DOCUMENTS

| | | | |
|---|---|---|---|
| 2,808,351 | 10/1957 | Colbert | 338/308 |
| 3,686,473 | 8/1972 | Shirn et al. | 219/219 |
| 3,839,620 | 10/1974 | Seibel et al. | 219/219 |
| 4,352,006 | 9/1982 | Zega | 219/219 |
| 4,459,470 | 7/1984 | Shlichta et al. | 219/522 |
| 4,634,242 | 1/1987 | Taguchi et al. | 359/512 |
| 4,634,835 | 1/1987 | Suzuki | 219/219 |
| 4,724,304 | 2/1988 | Teshima et al. | 219/219 |
| 4,940,317 | 7/1990 | Reuben | 219/219 |
| 5,155,340 | 10/1992 | Morita et al. | 219/543 |
| 5,155,625 | 10/1992 | Komatsu et al. | 219/219 |
| 5,406,049 | 4/1995 | Reiser et al. | 219/522 |

FOREIGN PATENT DOCUMENTS

| | | | |
|---|---|---|---|
| 55-16448 | 5/1980 | Japan | 338/308 |
| 58-28937 | 6/1983 | Japan . | |
| 60-195258 | 12/1985 | Japan . | |
| 61-192963 | 12/1986 | Japan . | |
| 62-112632 | 7/1987 | Japan . | |
| 62-33648 | 8/1987 | Japan . | |
| 63-66034 | 12/1988 | Japan . | |
| 0124095 | 5/1989 | Japan . | |
| 4102599 | 9/1992 | Japan . | |
| 0513872 | 2/1993 | Japan . | |
| 7-156758 | 6/1995 | Japan . | |
| 8-53050 | 2/1996 | Japan . | |
| 9-11864 | 1/1997 | Japan . | |
| 9-405 | 1/1997 | Japan . | |
| 415912 | 9/1934 | United Kingdom | 219/543 |

OTHER PUBLICATIONS

"Electrical Conducting Coating", Corning Glass Works Product Information Bulletin, Section H, Apr. 1959.

*Primary Examiner*—Tu Ba Hoang
*Attorney, Agent, or Firm*—Adams & Wilks

[57] ABSTRACT

In a mirror with a heater, a reflective heating resistor film, or a reflection film and a heating resistor film, are formed on a mirror base plate. The heating resistor film is provided with at least one pair of electrodes to apply electricity to and heat the film. The reflective heating resistor film, reflection film and/or heating resistor film are so arranged as to form a clear visible image and to be heated. The temperature of the mirror surface can be controlled, and the electrodes are formed so as to heat the entire surface of the mirror uniformly.

7 Claims, 17 Drawing Sheets

ELECTRIC HEATING DEVICE FOR MIRROR

FIELD OF TECHNOLOGY

The present invention relates to a mirror with a heater, which has a reflective film-cum-heating resistor film, or a reflection film and a heating resistor film, formed on a mirror base plate and includes at least a pair of electrodes for applying current to the heating resistor film to heat it, and which is suitably used in a bathroom and a vehicle and can prevent its surface from being clouded with moisture, rain droplets, dew or ice.

BACKGROUND TECHNOLOGY

When a vehicle is traveling in rainy or snowy weather, the outside mirrors are clouded with water droplets or ice, degrading the rearward view and therefore lowering the safety of driving. To prevent this, various types of mirrors have been proposed; which can be heated to remove water droplets and ice adhering to the mirror surface.

For example, Japanese Utility Model Publication No. 58-28937/1983 discloses a mirror for a vehicle, in which a heat distribution plate with high heat conductivity is attached to the back of a mirror base plate and has a heating body bonded to the back of the heat.

Further, Japan Utility Model Publication No. 62- 33648/1987 discloses a mirror with heater, in which a flat heater is fixed to the back of a mirror body and the pattern of the heater is made more dense in the peripheral portion of the mirror than in the center.

Further, Japanese Utility Model Publication No. 102599/1992 discloses a flat heating body for a mirror, in which a heating region is divided into sections by electrodes.

The above-mentioned mirror and flat heating body for a mirror adopts a structure in which an electric heating plate which has a complex heating resistor pattern or a complex electrode pattern is fixed to the back of the mirror base plate in order to heat the entire mirror surface evenly to provide a good view. By the method using the electric heating plate, which is provided separately from the mirror base plate, it is necessary to design and manufacture a complex heating resistor pattern and electrode pattern, which increases the cost. Another drawback of this method is that because the mirror base plate is heated through the conduction of heat from the separate electric heating plate, the heat efficiency is low and it takes a long time to remove water droplets.

To solve the above problems, Japanese Utility Model Laid-Open No. 5-13872/1993 proposes a mirror with a heater, in which chromium or NICHROME is deposited on the surface of the mirror base plate by vacuum vapor deposition or sputtering to form a reflective heating resistor film whose surface is coated with an insulating overcoat layer.

Ordinary mirror reflection films are made of such materials as aluminum and chromium deposited by vacuum vapor deposition and sputtering.

It is, however, difficult to use an aluminum or chromium film as the reflective film-cum-heating resistor (reflective heating resistor film) of the mirror with a heater. The reason for this is that the electrical resistivity of aluminum and chromium is low. That is, a film made of aluminum or chromium has a low resistance, which allows a large current to flow, increasing the power consumption and making the temperature control difficult.

One possible method of solving this problem is to raise the resistance of the film made of aluminum or chromium, that is, to reduce the thickness of the aluminum or chromium film formed as the reflective heating resistor film as much as possible.

When a mirror with a heater is used for a vehicle, the current applied to the mirror is preferably in a range of 1 to 5 A. If the current is under this range, the mirror may lack the ability to melt ice in the cold season, especially when exposed to wind; and if the applied current is over this range, the current application by temperature control function may result in overheat due to overshoot, burning of peripheral components and even a human. Considering the fact that in the case of vehicles a voltage of DC 12 V is applied to a mirror with a heater, the sheet resistance of the reflective heating resistor film of the mirror is preferably in the range of 4–20 Ω/□ to enable uniform heating of the mirror irrespective of its shape.

Considering the above, it is therefore possible to use aluminum or chromium for the heating resistor of the mirror with a heater for vehicles if the film thickness is set below 0.01 μm when aluminum is used for the reflective heating resistor film and If the film thickness is set below 0.03 μm when chromium is used. With such a thin film, even though the film is made of metal, transmission of light through the film cannot be ignored and the mirror works as a half-mirror rather than as a reflective mirror, raising a problem that depending on how light falls on to the mirror, the back side may be seen through the film thereby, degrading the view of vision of the mirror. Further, though electrodes for applying current and heating the reflective heating resistor film are attached to the film, the adhesion of the chromium film to the electrodes is poor.

Another method of solving the above problem may be to use a material for the film which has a higher electrical resistivity than aluminum and chromium.

Materials with high electrical resistivity include silicides such as NICHROME, chrome silicide and titanium silicide.

NICHROME, however, has a poor adhesion to electrode materials and consequently it is hard to achieve a stable performance. The chromium silicide film needs to be at least about 1 μm thick to conduct a desired heating current but the film itself easily cracks due to stresses and the mirror base plate such as of glass may break during heating. This phenomenon is particularly noticeable in a concave mirror in which residual bending stress remains in the glass plate. Moreover, silicides generally have a low reflectivity (reflection factor) of around 30%, and at such a low level of reflectivity the function as a reflection film of the mirror cannot be fulfilled.

Further, the heating resistor is restricted by its temperature coefficient of resistance. When the temperature coefficient of resistance is too large, the heater resistance increases with an increasing temperature and reduces the current, it takes a long time for the mirror to be heated to a desired temperature, making it impossible to completely remove water droplets and ice. When, on the contrary, the temperature coefficient of resistance is too small, the current application by temperature control function may result in overheat due to current overshoot, burning peripheral components and even humans.

When a reflective heating resistor film is formed on the surface of the mirror base plate, only the central part of the mirror is easy to heat. For uniform heating of the entire mirror surface, conventionally the electrodes are provided near the peripheral portion of the mirror base plate. This method is often not effective. Mirrors for cars generally have a mirror base plate of a figure, not a circle nor rectangle, but generally parallelogram, trapezoid, oval and diamond having a narrow angle portion whose interior angle defined by the edges of the mirror base plate is small and a wide angle portion whose interior angle is large. When such a mirror base plate is used, the wide angle portion is more likely to be heated. To quickly remove water droplets in the narrow angle portion that is difficult to heat, a large amount of electricity is required. Not only is this inefficient but it may also overheat the wide angle portion, burning and deforming peripheral components such as resin holders and even burning a human when he or she touches the mirror.

As described above, the mirror with a heater disclosed in Japanese Utility Model Laid-Open No. 13872/1993 does not meet the expectations in quality.

DISCLOSURE OF INVENTION

An object of this invention is to provide a mirror with a heater which has an appropriate reflectivity and can form a clearly recognizable mirror image and whose surface temperature can be controlled and raised to quickly remove water droplets or ice adhering thereto.

Another object of this invention is to provide a mirror with a heater in which the entire surface of the mirror base plate can be heated uniformly, making it possible to control the temperature, and quickly removing water droplets or ice adhering thereto.

A first gist of this invention is a mirror with a heater which comprises a reflective heating resistor film, or a reflection film and a heating resistor film formed on the mirror base plate and at least a pair of opposing electrodes to apply electricity to the heating resistor film to heat it, the reflective heating resistor film or a heating resistor film being made of titanium.

A second gist of this invention is a mirror with a heater in which a first layer with a reflectivity of 40% or higher is formed on the mirror base plate, a second layer with an electrical resistivity of 20 $\mu\Omega\cdot$cm or higher is formed over the first layer, and electrodes are connected to the second layer.

A third gist of this invention is a mirror with a heater in which a reflective heating resistor film or a heating resistor film consisting of multiple layers having different temperature coefficients of resistance, is formed on the mirror base plate, and electrodes are attached to the reflective heating resistor film or the heating resistor film.

A fourth gist of this invention is a mirror with a heater in which a reflective heating resistor film, or a reflection film and a heating resistor film is formed on the mirror base plate and at least a pair of opposing electrodes for applying electricity to the heating resistor film and heating it; wherein the opposing electrodes are formed in such a way that the electrode interval near the ends of the mirror base plate are narrower than that at the central part of the mirror base plate.

A fifth gist of this invention is a mirror with a heater in which a reflective heating resistor film, or a reflection film and a heating resistor film is formed on the mirror base plate and at least a pair of opposing electrodes for applying electricity to the heating resistor film and heating it; wherein the maximum voltage drop between the electrodes with respect to the feeding point of the electrodes is 0.5–20% of the supply voltage.

BEST MODE FOR EMBODYING THE INVENTION

Embodiment 1

Figure 1:
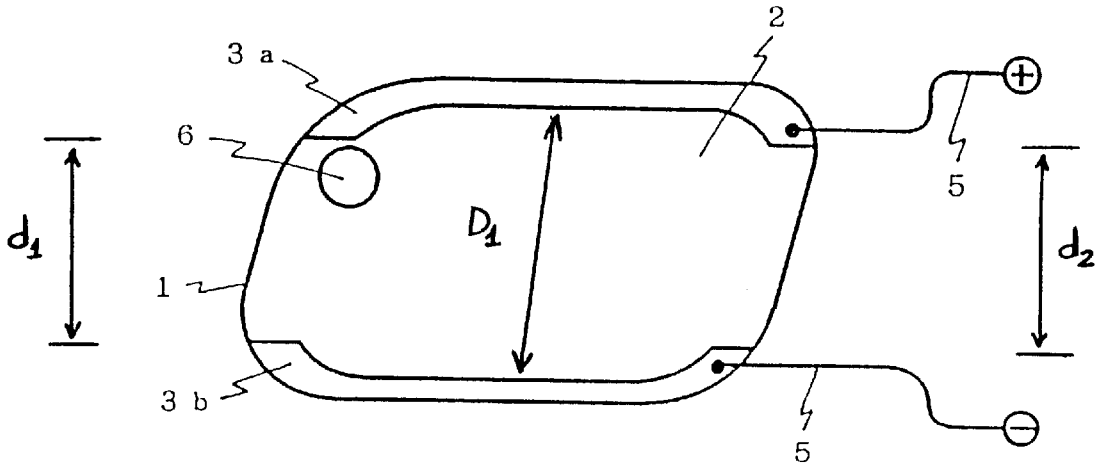
FIG. 1 is a schematic perspective view showing the back of a first embodiment.
Figure 2:
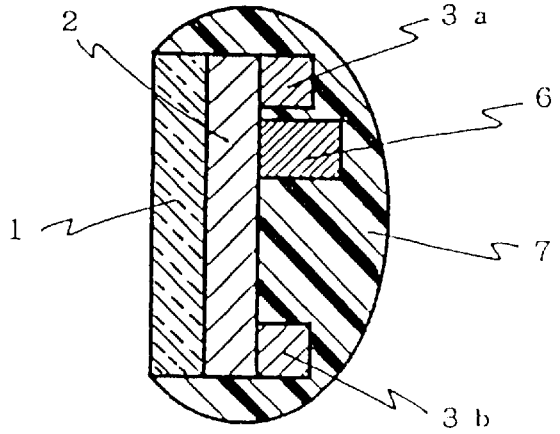
FIG. 2 is a schematic vertical cross section of a second embodiment.

FIG. 1 is a schematic perspective view showing the back of a mirror with a heater, used as a vehicle door mirror, and FIG. 2 is a schematic vertical cross section of FIG. 1.

Reference numeral 1 represents a mirror base plate made of such a transparent material as glass.

On the back of this mirror base plate 1 is formed a reflective heating resistor film 2, which is a titanium film deposited by sputtering or vacuum vapor deposition. The titanium film referred to here is formed by sputtering or vacuum vapor deposition and therefore includes titanium films containing a trace amount of impurity depending on the condition and equipment employed in the manufacturing process. The impurity may include oxygen, nitrogen and carbon, and their contents are up to 10 atomic percent for oxygen, up to 1 atomic percent for nitrogen and up to 5 atomic percent for carbon. The titanium film preferably has a thickness in a range of 0.05–0.15 $\mu$m depending on the shape of the mirror.

Further, provided on the back of the reflective heating resistor film 2 are a pair of opposing electrodes 3*a*, 3*b* for applying electricity to the reflective heating resistor film 2. To uniformly heat the entire surface of the mirror, the intervals $d_1$, $d_2$ of the electrodes 3*a*, 3*b* near the corners of the mirror base plate 1 are narrower than the electrode interval $D_1$ at the central part. These electrodes 3*a*, 3*b* can be formed by a variety of methods. For example, a copper paste or silver paste may be used to form a thin layer of copper or silver, and solder is applied to the layer. Alternatively, a thin film of nickel or gold is formed by nickel or gold plating and the plating layer is used as electrodes.

For electric insulation, the back of the mirror is coated with an insulating material 7, such as resin or rubber, which has such a low Young's modulus that the coating does not crack when subjected to temperature change.

Reference numeral 5 represents lead wires connecting the electrodes 3 and a power supply circuit (not shown).

Reference numeral 6 denotes a temperature control element for controlling the heating.

In the first embodiment, the mirror with a heater was fabricated as follows. On the mirror base plate 1 of glass a titanium film is deposited to a thickness of 0.1 $\mu$m by sputtering to form a reflective heating resistor film 2.

When a DC voltage of 12 V was applied across the mirror, a current of 4 A flowed. When the heating of the mirror was controlled by a temperature control circuit having a thermistor as a temperature detector or by a thermostat, the temperature of the mirror surface was able to be controlled in a range of 50–60° C. as set beforehand. The mirror had a reflection factor of 45–50%, which was slightly lower than that of a conventional chromium reflection film, but it can be used as a mirror without raising any problem. Also, it did not cause a problem that the back of the mirror was seen irrespective of the way the light struck the mirror. Further, other problems that the film cracked due to stress and that the glass plate forming the mirror base plate was broken during heating, did not occur.

Embodiment 2

Figure 3:
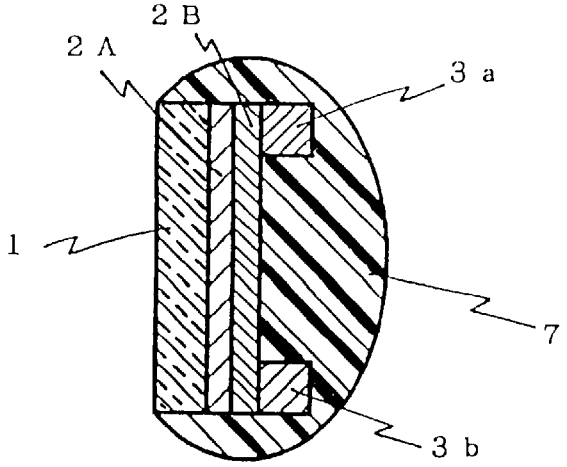
FIG. 3 is a schematic vertical cross section of second to fourth embodiments.

FIG. 1 is a schematic perspective view showing the back of a mirror with a heater used as a vehicle door mirror. FIG. 3 is a schematic vertical cross section of the mirror.

Reference numeral 1 is a mirror base plate made of a transparent material such as glass.

On the mirror base plate 1 was formed a first layer 2A with a reflectivity of 40% or higher. The reflectivity was measured by the measuring method defined in JIS D 5705. The first layer 2A with the reflectivity of 40% or higher was formed of such materials as aluminum, chromium, nickel, nichrome alloy, and nickel-phosphorus by sputtering, vacuum vapor deposition or plating.

Over the first layer 2A with the reflectivity factor of 40% or higher was formed a second layer 2B having a electrical resistivity of 20 $\mu\Omega\cdot$cm, whose material was titanium, titanium silicide, chromium silicide, tantalum nitride, titanium carbide, tungsten carbide, niobium boride, or iron-chromium-aluminum alloy by sputtering, vacuum vapor deposition or plating.

The first layer 2A functions as a reflective heating resistor film and the second layer 2B as a heating resistor. The preferable thickness of the first layer 2A, though it depends on the material used, is less than 0.01 $\mu$m when aluminum is used, 0.01–0.03 $\mu$m when chromium is used, and 0.01–0.3 $\mu$m when chromium alloy is used.

The second layer 2B is provided with a pair of opposing electrodes 3*a*, 3*b* to apply electricity. These opposing electrodes 3*a*, 3*b* are arranged in such a manner that the distance between them is narrower near the corners of the mirror base plate 1 than at the central part. The electrodes 3*a*, 3*b* can be made in any of the ways as mentioned earlier.

The back of the mirror is coated, for electric insulation, with an insulating material 7, such as resin or rubber, which has such a low Young's modulus that the coating does not crack when subjected to temperature change.

Reference numeral 5 represents lead wires connecting the electrode 3*a*, 3*b* and a power supply circuit (not shown).

In Embodiment 2, a mirror with a heater was manufactured in the following manner. A chromium film was formed by sputtering over the mirror base plate 1 of glass to a thickness of 0.02 μm to form the first layer 2A. On the first layer 2A was deposited chromium silicide to a thickness of 0.2 μm to form the second layer 2B with an electrical resistivity of 1,400 μΩ·cm. Next, on the second layer 2B was deposited a copper paste to form a copper thin film, on which solder is applied to form electrodes 3.

When a DC voltage of 12 V was applied across the mirror, a current of 3.3 A flowed. When the heating of the mirror was controlled by a thermostat, the temperature of the mirror surface was able to be controlled in a range of 50–60° C. as set beforehand. The mirror had a reflectivity of 51%, which was almost equal to that of a conventional mirror with a chromium reflection film about 0.2 μm thick, and formed a good mirror image. Further, the rear part of the mirror was not seen however light struck the mirror.

Embodiment 3

As in Embodiment 2, the following steps were taken to make a mirror with a heater.

A nichrome alloy film was formed by sputtering over a mirror base plate 1 of glass to a thickness of 0.1 μm to form a first layer 2A. On the first layer 2A was deposited titanium silicide to a thickness of 0.1 μm to form a second layer 2B with an electrical resistivity of 130 μΩ·cm. Next, to the second layer 2B was applied a copper paste to form a copper thin film, on which solder was deposited to form electrodes 3.

When a DC voltage of 12 V was applied across the mirror, a current of 3.2 A flowed. When the heating of the mirror was controlled by a thermostat, the temperature of the mirror surface was able to be controlled in a range of 50–60° C. as set beforehand. The mirror had a reflectivity of 55%, which was almost equal to that of a conventional mirror with a chromium reflection film, and formed a good mirror image. Further, the rear part of the mirror was not seen however light struck the mirror. This mirror also exhibited a good adhesion to electrodes.

Embodiment 4

As in Embodiment 2, the following steps were taken to make a mirror with a heater.

A nichrome alloy film was formed by sputtering over a mirror base plate 1 of glass to a thickness of 0.05 μm to form a first layer 2A. On the first layer 2A was deposited titanium to a thickness of 0.02 μm to form a second layer 2B with an electrical resistivity of 50 μΩ·cm. Next, to the second layer 2B was applied a copper paste to form a copper thin film, on which solder was applied to form electrodes 3.

When a voltage of DC 12 V was applied across the mirror, a current of 1.6 A flowed. When the heating of the mirror was controlled by a thermostat, the temperature of the mirror surface was able to be controlled in a range of 50–60° C. as set beforehand. The mirror had a reflectivity of 53%, which was almost equal to that of a conventional mirror with a chromium reflection film, and formed a good mirror image. Further, the rear part of the mirror was not seen however light struck the mirror.

Embodiment 5

Figure 4:
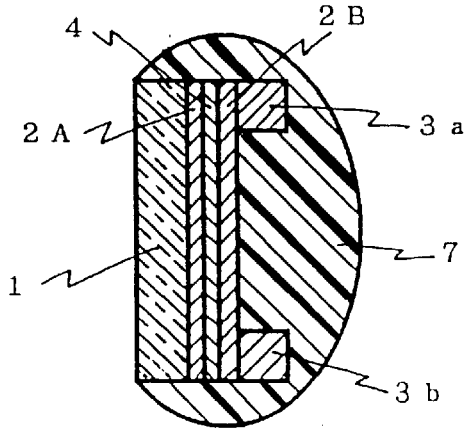
FIG. 4 is a schematic vertical cross section of a fifth embodiment.

When a material with a very small electrical resistivity such as aluminum is used for a first layer 2A, an insulating layer 4 of, say, silica may be interposed between the first layer 2A and a second layer 2B, as shown in FIG. 4, to electrically isolate them. In that case, the first layer 2A serves as a reflection film and the second layer 2B as a heating resistor film.

In the embodiment 5, an aluminum film was formed by sputtering over the mirror base plate 1 of glass to a thickness of 0.3 μm to form the first layer 2A. On the first layer 2A was deposited silica to a thickness of 0.5 μm to form an insulating layer 4, over which titanium was deposited to a thickness of 0.05 μm to form the second layer 2B with an electrical resistivity of 50 μΩ·cm. Next, to the second layer 2B was applied a copper paste to form a copper thin film, on which solder was deposited to form electrodes 3*a*, 3*b*.

When a voltage of DC 12 V was applied across the mirror, a current of 2.0 A flowed. When the heating of the mirror was controlled by a thermostat, the temperature of the mirror surface was able to be controlled in a range of 50–60° C. according to the setting. The mirror has a reflectivity of 85%, which is almost equal to that of a conventional mirror with an aluminum film, and formed a good mirror image. Further, the rear part of the mirror was not seen in whatever direction light struck the mirror.

Embodiment 6

Figure 5:
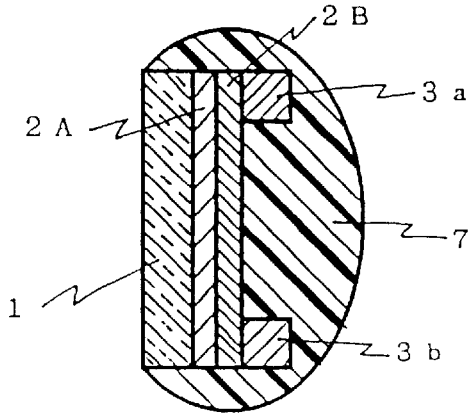
FIG. 5 is a schematic vertical cross section of sixth to ninth embodiments.

FIG. 1 is a schematic perspective view showing the back of a mirror with a heater mounted on a vehicle door. FIG. 5 is a schematic vertical cross section of the mirror.

Reference numeral 1 is a mirror base plate made of a transparent material such as glass. On the mirror base plate 1 is deposited a reflective heating resistor film 2 thereon.

The reflective heating resistor film 2 comprises a first layer 2A with a reflectivity of more than 40% on the mirror base plate 1 and a second layer 2B formed over the first layer 2A. The first layer 2A and the second layer 2B have different temperature coefficients of resistance. The second layer 2B had an excellent adhesion to electrodes 3*a*, 3*b* described later. The reflectivity was measured by the measuring method defined in the JIS D 5705.

The first layer 2A on the mirror base plate 1 having a reflectivity of 40% or higher is formed of such a material as aluminum, chromium, nickel, aluminum-nickel alloy, aluminum-titanium alloy, nichrome alloy or nickel-phosphorus by sputtering, vacuum vapor deposition or plating.

The second layer 2B with an excellent adhesion to the electrodes 3*a*, 3*b* has a temperature coefficient of resistance different from that of the first layer 2A. The material is selected out of titanium, titanium silicide, chromium silicide, tantalum and its nitride, titanium carbide, tungsten carbide, niobium boride, and ion-chromium-aluminum alloy. The second layer 2B is formed by sputtering, vacuum vapor deposition or plating on the first layer 2A.

The first layer 2A functions as a reflective heating resistor film and the second layer 2B as a heating resistor film. In this case, the temperature coefficient of resistance of the heating resistor is nearly the weighted mean of reciprocals of sheet resistances of the first and second layer 2A, 2B.

The variation in resistance of the heating resistor of the mirror is preferably within ±10% at 20±50° C. which is the condition where vehicles are used. To keep the resistance variation within ±10%, the temperature coefficient of resistance of the reflective heating resistor film is preferably less than ±2,000 ppm. Further, provided on the second layer 2B are a pair of opposing electrodes 3*a*, 3*b* to apply electricity to this layer. To uniformly heating the entire surface of the mirror, the opposing electrodes 3*a*, 3*b* are formed in such a way that the electrode interval is narrower near the corners of the mirror base plate 1 than at the central part.

These electrodes 3*a*, 3*b* can be formed by a variety of methods.

For electric insulation, the back of the mirror is coated with an insulating material, such as resin and rubber, which has such a low Young's modulus that the coating does not crack when subjected to temperature change.

Reference numeral 5 represents lead wires connecting the electrodes 3*a*, 3*b* and a power supply circuit (not shown).

Reference numeral 6 is a temperature detecting element such as a thermostat or a thermistor, a temperature control circuit, or a thermal cutoff for fire prevention.

The reflective heating resistor film 2, though it has been described as a film having a two-layer structure, may have a multilayer structure, e.g., three- or four-layer structure.

Figure 6:
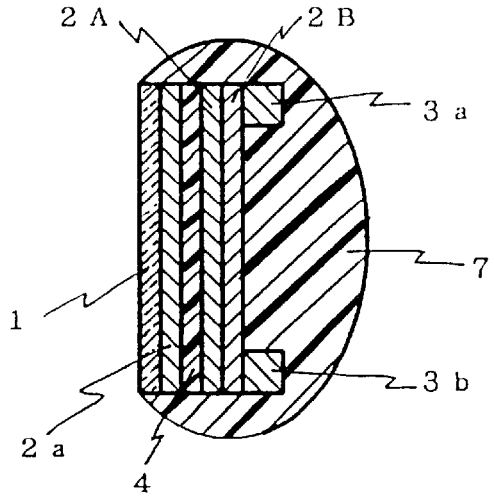
FIG. 6 is a schematic vertical cross section of another embodiment.

When a material with a very low electrical resistivity such as aluminum is used for the reflective layer, an insulating layer 4 of, say, silica may be interposed between the reflective layer 2*a* and the first layer 2A, as shown in FIG. 6, to electrically isolate them. In that case, both the first layer 2A and the second layer 2B work as heating resistor films.

In Embodiment 6, a film of nichrome alloy with a temperature coefficient of resistance of +100 ppm/°C. was formed by sputtering over the mirror base plate 1 of glass as the first layer 2A in such a way that it has a sheet resistance of 12 Ω/□. Titanium with a temperature coefficient of resistance of +2,400 ppm/°C. was deposited over the first layer 2A as the second layer 2B having a sheet resistivity of 12 Ω/□. The reflective heating resistor film 2 consisting of these two layers had a sheet resistivity of 6 Ω/□ and a temperature coefficient of resistance of +1,250 ppm/°C.

Next, a copper paste was applied to the second layer 2B to form a thin copper layer, to which solder was applied to form electrodes 3*a*, 3*b*, thus completing a mirror with a heater.

When a DC voltage of 12 V was applied across the mirror, and its heating was controlled by a thermostat, the temperature of the mirror surface reached the maximum temperature in 60 seconds without any overshoot and was able to be controlled in a range of 50–60° C. as set beforehand.

The mirror had a reflectivity of 51%, which was almost equal to that of a conventional mirror having a chromium reflection film about 0.2 μm thick. No problem was found with the mirror in terms of electrode bonding strength.

Embodiment 7

As in Embodiment 6, the following steps were taken to make a mirror with a heater.

A nichrome alloy with a temperature coefficient of resistance of +100 ppm/°C. was deposited by sputtering over the mirror base plate 1 of glass to form a first layer 2A which has a sheet resistivity of 8 Ω/□. Titanium with a temperature coefficient of resistance of +2,400 ppm/[illegible] was deposited over the first layer 2A to form a second layer 2B having a sheet resistivity of 24 Ω/□. The reflective heating resistor film 2 consisting of these two layers was found to have a sheet resistivity of 6 Ω/□ and a temperature coefficient of resistance of +670 ppm/°C.

Next, a copper paste was applied to the second layer 2B to form a thin copper layer, to which solder was applied to form electrodes 3*a*, 3*b*, thus completing a mirror with a heater.

When a DC voltage of 12 V was applied to the mirror, and its heating was controlled by a thermostat, the temperature of the mirror surface reached the maximum temperature in 55 seconds without any overshoot and was able to be controlled in a range of 50–60° C. as set beforehand.

The mirror had a reflectivity of 51%, which was almost equal to that of a conventional mirror having a chromium reflection film about 0.2 μm thick. No problem was found with the mirror in terms of adhesion of the electrodes.

Embodiment 8

As in Embodiment 6, the following steps were taken to make a mirror with a heater.

Titanium with a temperature coefficient of resistance of +2,400 ppm/°C. was deposited by sputtering over the mirror base plate 1 of glass to form a first layer 2A which had a sheet resistivity of 12 Ω/□. Titanium silicide containing nitrogen with a temperature coefficient of resistance of −2,400 ppm/°C. was deposited over the first layer 2A to form a second layer 2B whose sheet resistivity is 12 Ω/□. The reflective heating resistor film 2 consisting of these two layers was found to have a sheet resistivity of 6 Ω/□ and a temperature coefficient of resistance of 0 ppm/°C.

Next, a copper paste was applied to the second layer 2B to form a thin copper layer, to which solder was applied to form electrodes 3*a*, 3*b*, thus completing a mirror with a heater.

When a DC voltage of 12 V was applied across the mirror and its heating was controlled by a thermostat, the temperature of the mirror surface reached the maximum temperature in 53 seconds without any over-shoot and was able to be controlled in a range of 50–63° C. as set beforehand.

The mirror had a reflectivity factor of 41%, which was slightly lower than that of a conventional mirror having a chromium film, but can function as desired. No problem was found with the mirror in terms of the adhesion of the electrodes.

Embodiment 9

As in Embodiment 6, the following steps were taken to make a mirror with a heater.

A nichrome alloy with a temperature coefficient of resistance of +100 ppm/°C. was deposited by sputtering over the mirror base plate 1 of glass to form a first layer 2A which had a sheet resistivity of 24 Ω/□. Titanium silicide containing nitrogen with a temperature coefficient of resistance of −2,400 ppm/°C. was deposited over the first layer 2A to form a second layer 2B whose sheet resistivity was 8 Ω/□. The reflective heating resistor film 2 consisting of these two layers was found to have a sheet resistance of 6 Ω/□ and a temperature coefficient of resistance of −1,780 ppm/°C.

Next, a copper paste was applied to the second layer 2B to form a thin copper layer, to which a solder was applied to form electrodes 3, thus completing a mirror with a heater.

When a DC voltage of 12 V was applied across the mirror, and its heating was controlled by a thermostat, the temperature of the mirror surface reached the maximum temperature in 50 seconds, though with a little overshoot, and was able to be controlled in a range of 50–65° C. as set beforehand.

The mirror had a reflectivity of 51%, which was almost equal to that of a conventional mirror having a chromium film. No problem was found with the mirror in terms of electrode bonding characteristics.

Embodiment 10

Figure 7:
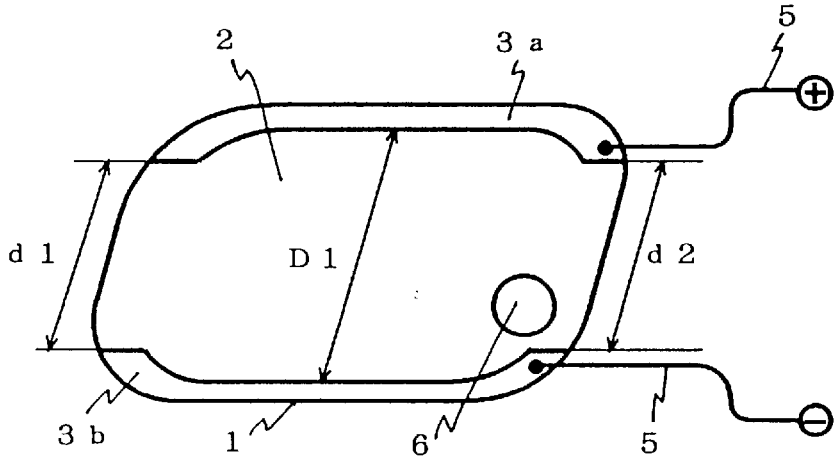
FIG. 7 is a schematic perspective view showing the back of a tenth embodiment.

FIG. 7 is a schematic perspective view showing the back of a mirror with a heater used as a vehicle door mirror. FIG. 2 is a schematic vertical cross section of the mirror.

Reference numeral 1 is a mirror base plate made of a transparent material such as glass.

On the back of the mirror base plate 1, a reflective heating resistor film 2 of titanium, chromium or nichrome was formed by sputtering or vacuum vapor deposition. The reflective heating resistor film 2 may have a different in structure from that of this embodiment in which the film formed on the back of the mirror base plate 1 serves both as the reflection film and the heating resistor film. For example, a multilayer film may be formed, each of the layers having two functions of a reflection film and a heating resistor film. It is also possible to form an insulating layer between the reflection film and the heating resistor film to electrically isolate them from each other.

When a multilayer film is formed, the first layer may be made of aluminum, chromium, nickel, nichrome alloy, or nickel-phosphorus by sputtering, vacuum vapor deposition and plating. The second layer may be formed of titanium, titanium silicide, chromium silicide, tantalum nitride, titanium carbide, tungsten carbide, niobium boride, or iron-chromium-aluminum alloy by sputtering, vacuum vapor deposition or plating.

When a reflection film and a heating resistor film are formed separately, the material of the reflective film is aluminum, chromium, nickel, nichrome alloy, or nickel-phosphorous, and the film is formed by sputtering, vacuum vapor deposition or plating; the material of the insulating layer is silica; and the material of the heating resistor film is titanium, titanium silicide, chromium silicide, tantalum nitride, titanium carbide, tungsten carbide, niobium boride, or iron-chromium-aluminum alloy, and the film is formed by sputtering, vacuum vapor deposition or plating.

Further, the back of the reflective heating resistor film 2 was provided with a pair of opposing electrodes 3*a*, 3*b* to apply electricity to the film. The opposing electrodes 3*a*, 3*b* were arranged in such a way that the electrode intervals $d_1$, $d_2$ near the corners of the mirror base plate 1 were narrower than the electrode interval $D_1$ at the central part. These electrodes 3*a*, 3*b* can be formed by a variety of methods, as mentioned earlier.

The back of the mirror was coated with an insulating material 7 such as resin for electric insulation.

Reference numeral 5 represents lead wires to connect the electrodes 3 and the power supply circuit (not shown).

Reference numeral 6 designates a temperature control element for the control of heating.

In such a heating resistor film described above, the resistance of the central part of the mirror generally tends to be smaller than those of the corner parts and thus the central part is easily heated. By forming the heating resistor film in such a way that the electrode intervals $d_1$, $d_2$ near the corners of the mirror are narrower than the electrode interval $D_1$ at the central part, as in this embodiment, it is possible to heat the corner portions and the central portion equally. Hence, water droplets can be removed evenly from the entire mirror surface without having to apply an excessive power.

In the mirror of this invention, the corner portion of the mirror on the side connected to the lead wires 5 is difficult to heat because a greater amount of heat is conducted to the lead wires 5 from this side than from the opposite side. Hence, by setting the electrode interval at the corner portion of the mirror on the lead wire connection side narrower than the electrode interval at the opposite side, it is possible to achieve uniform heating of the mirror.

Embodiment 11

Figure 8:
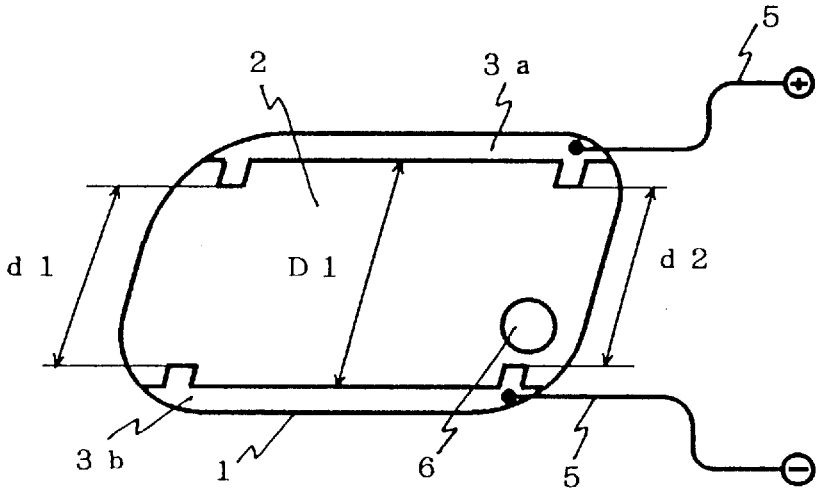
FIG. 8 is a schematic perspective view showing the back of an eleventh embodiment.

FIG. 8 shows Embodiment 11, which is similar to Embodiment 10 except that the electrode intervals $d_1$, $d_2$, narrower than the electrode interval $D_1$ at the center of the mirror, represent the distances between the opposing, inwardly projecting portions of the electrodes located near the corners of the mirror base plate 1. The effects of this arrangement is similar to that of the embodiment 10.

Embodiment 12

Figure 9:
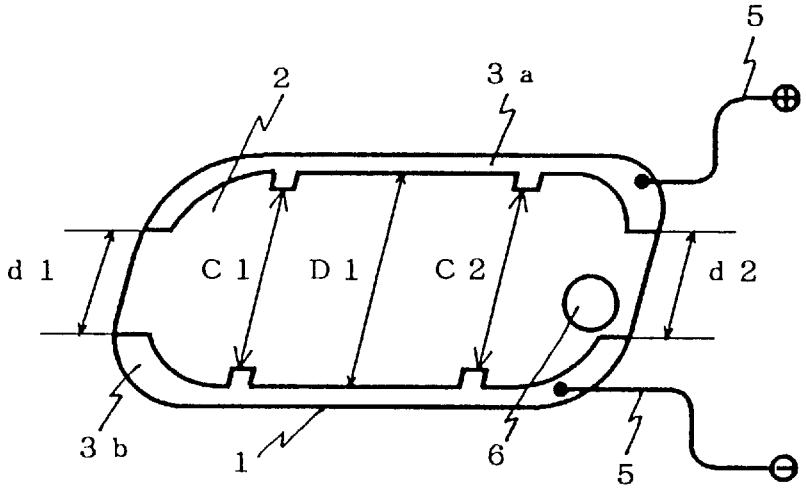
FIG. 9 is a schematic perspective view showing the back of a twelfth embodiment.

FIG. 9 shows Embodiment 12, in which opposing two pairs of electrode portions of which the intervals $C_1$, $C_2$ are smaller than the electrode interval $D_1$ at the central part of the mirror base plate 1, are provided other than the corner portions of the mirror base plate 1 of Embodiment 10. The advantage of Embodiment 12 is similar to that of Embodiment 10 and is particularly remarkable when the mirror shape is close to a rectangle or parallelogram along long sides of which the electrodes are formed.

Embodiment 13

Figure 10:
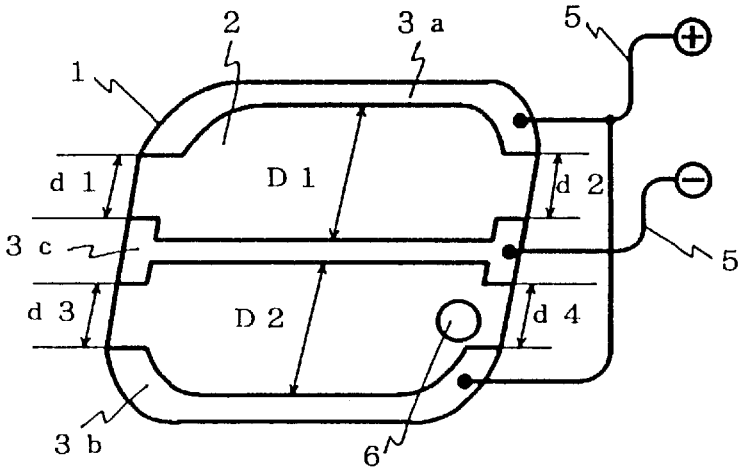
FIG. 10 is a schematic vertical cross section of a thirteenth embodiment.

FIG. 10 shows Embodiment 13. In Embodiment 13, electrodes 3*a*, 3*b* are provided along the opposing long sides of the mirror base plate 1, and another electrode 3*c* is provided between these electrodes 3*a*, 3*b*, the electrodes 3*a*, 3*b* being positive and the electrode 3*c* negative. In the relation between the electrode 3*a* and the electrode 3*c*, the electrode intervals $d_1$, $d_2$ along the short sides are narrower than the electrode interval $D_1$ at the central portion. In the relation between the electrode 3*b* and the electrode 3*c*, the electrode intervals $d_3$, $d_4$ along the short sides are narrower than the electrode interval $D_2$ at the central portion. The advantage of Embodiment 13 is similar to that of Embodiment 10 and is particularly great when the mirror shape is close to a square or diamond.

Embodiment 14

Figure 11:
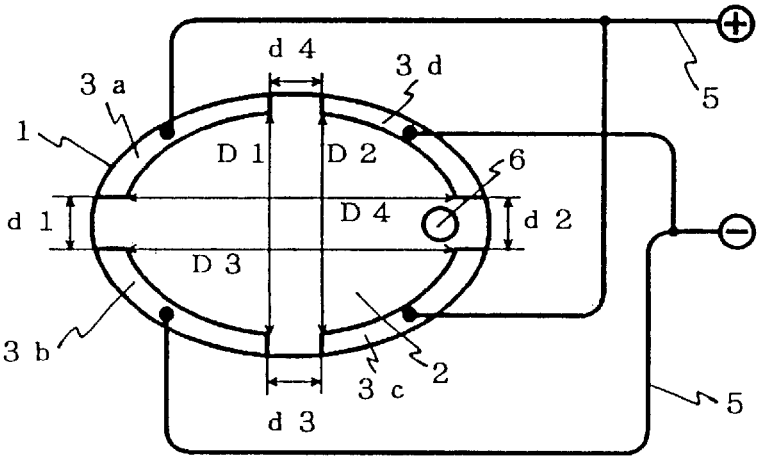
FIG. 11 is a schematic perspective view showing the back of a fourteenth embodiment.

FIG. 11 shows Embodiment 14, in which the mirror is shaped in a circle or an oval and in which two pairs of opposing electrodes 3*a*, 3*b* and 3*c*, 3*d* are so arranged that the electrode intervals $d_1$, $d_2$, $d_3$, $d_4$ between the adjacent ends of the electrodes 3*a* to 3*d* are narrower than the electrode intervals $D_1$, $D_2$, $D_3$, $D_4$ along two diameters or the major and minor axes. The advantage of Embodiment 14 is similar to that of Embodiment 10.

Embodiment 15

Figure 12:
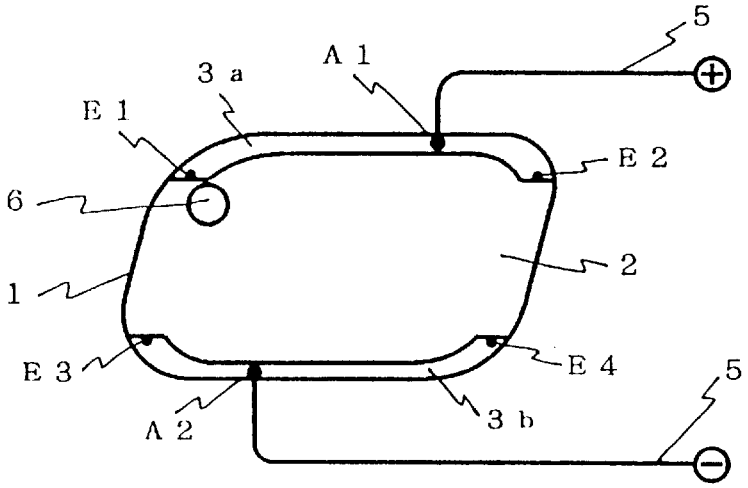
FIG. 12 is a schematic perspective view showing the back of fifteenth to nineteenth embodiments.

FIG. 12 is a schematic perspective view showing the back of a mirror with a heater mounted on a vehicle door. FIG. 2 is a schematic vertical cross section of the mirror.

Reference numeral 1 is a mirror base plate made of a transparent material such as glass. The back of the mirror base plate 1 is formed with a reflective heating resistor film 2.

The back of the reflective heating resistor film 2 Is provided with a pair of opposing electrodes 3*a*, 3*b* to apply electricity to the film. To heat the left and right side portions of the mirror (in FIG. 12), the opposing electrodes 3*a*, 3*b* are so arranged that the interval between the electrodes 3*a*, 3*b* along the left and right sides of the mirror base plate 1 is narrower than the electrode interval at the central portion.

These electrodes 3*a*, 3*b* can be formed in a variety of ways, as mentioned earlier.

Though the electrodes are normally formed to a uniform thickness and to a uniform width, it is possible to make the thickness and width of the electrodes uneven to change the resistance of the electrodes depending on the locations or to connect electrodes of two or more different materials to change the rate of voltage drop in the electrodes.

Further, the number of electrodes is not limited to two and, for example, another electrode may be added intermediate between the electrodes 3*a*, 3*b* in FIG. 12, using the electrodes 3*a*, 3*b* as anodes and using the added electrode as a cathode. Further in FIG. 12, another pair of electrodes may be added along the left and right sides of the base plate.

Furthermore, for electric insulation and corrosion resistance, the back of the reflective heating resistor film 2 and the back of the electrodes 3*a*, 3*b* are coated with an insulating material 7, such as resin and rubber, which has such a low Young's modulus that the coating does not crack when subjected to temperature change.

Reference numeral 5 represents lead wires to connect the electrodes 3*a*, 3*b* and a power supply circuit (not shown). The lead wires 5 are connected by, say, soldering to the electrodes 3*a*, 3*b*. A connection point $A_1$ of the lead wire 5 and the electrode 3*a* represents a power feeding point for the electrode 3*a*; and a connection point A2 of the lead wire 5 and the electrode 3*b* represents a power feeding point for the electrode 3*b*.

The voltage between the electrodes 3*a*, 3*b* drops more away from the feeding points $A_1$, $A_2$. Hence, end portions $E_1$, $E_2$ of the electrode 3*a* represent maximum voltage drop points in the electrode, and similarly end portions $E_3$, $E_4$ of the electrode 3*b* represent maximum voltage drop points in the electrode. In the maximum voltage drop points in the electrode, the maximum voltage drops need to be in a range of 0.5–20% of the supply voltage. When the maximum voltage drops are less than 0.5% of the supply voltage, the amount of heat produced by the electrodes is too small to evenly heat the entire surface of the mirror base plate including the electrodes. Contrarily, when the amount of maximum voltage drop exceeds 20% of the supply voltage, heating the entire mirror requires applying a large amount of electricity, resulting in a low efficiency, loss of electrodes, or cracks in glass.

Two or more power feeding points may be provided in each electrode.

In Embodiment 15, the reflective heating resistor film 2 is a titanium film 0.05 μm thick, on which electrodes 3 of copper thin film are deposited by screen printing. When a DC voltage of 12 V was applied between the feeding points $A_1$ and $A_2$ of the mirror, a current of 2.0 A flowed.

In the mirror of this embodiment, although the temperature was slightly higher at the current feeding points than other portions, the temperature of the mirror surface including portions corresponding to the electrodes was able to be controlled In a range of 45–65° C. as set beforehand.

Embodiment 16

A mirror with a heater of this embodiment was fabricated in a similar way to that of Embodiment 15, except that the thickness of the electrodes was made larger. The current between the electrodes was 2.1 A.

In the mirror of this embodiment, the temperature of the mirror surface including those portions corresponding to the electrodes was able to be controlled in a range of 50–60° C. as set beforehand.

Embodiment 17

A mirror with a heater of this embodiment was fabricated in a similar way to that of Embodiment 15, except that a reflective heating resistor film 2 was formed of titanium and had a thickness of 0.1 μm, and the electrodes 3 are made of silver. The current between the electrodes was 4.1 A.

In the mirror of this embodiment, the temperature of the mirror surface including those portions corresponding to the electrodes was able to be controlled in a range of 50–60° C. as set beforehand.

Embodiment 18

A mirror with a heater of this embodiment was fabricated in a way similar to that of Embodiment 17, except that a reflective heating resistor film 2 was formed of nichrome and had a thickness of 0.2 μm thick. The current between the electrodes were 3.7 A.

In the mirror of this embodiment, the temperature of the mirror surface including those portions corresponding to the electrodes was able to be controlled in a range of 50–60° C. according to the setting.

Embodiment 19

The mirror of this embodiment was made in a way similar to that of Embodiment 15, except that a titanium film was deposited on the 0.05-μm-thick nichrome film to a thickness of 0.05 μm to form a reflective heating resistor film 2, a thin copper film was formed on the thin silver layer to form electrodes 3, and that a thick solder film was formed on the electrodes. The current between the electrodes was 2.9 A.

In this mirror of this embodiment, although the temperature rise was slightly large particularly at around $E_1$, $E_4$, the temperature of the mirror surface including portions corresponding to the electrodes was able to be controlled in a range of 50–65° C. as set beforehand. The voltage drops between $A_1$–$E_2$ and $A_2$–$E_3$ were less than 0.5% of the supply voltage, but because the distances of $A_1$–$E_2$ and $A_2$–$E_3$ were short, these portions were also heated evenly.

Embodiment 20

Figure 13:
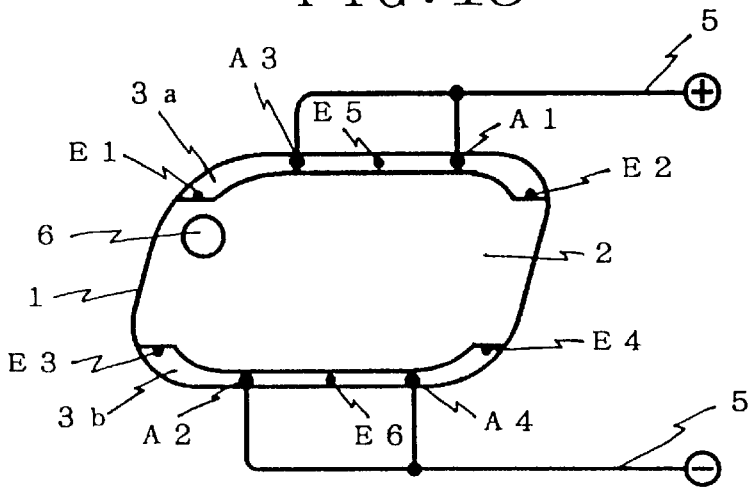
FIG. 13 is a schematic perspective view showing the back of a twentieth embodiment.

FIG. 13 is a schematic perspective view showing the back of Embodiment 20. This embodiment is similar to Embodiment 15, except that each electrode has two feeding points. In Embodiment 20, the feeding points for the electrode 3*a* are points $A_1$ and $A_3$, and the maximum voltage drop points in the electrode 3*a* are points $E_1$ and $E_2$, which are the ends of the electrode 3*a*, and a point $E_5$ which is a potentially intermediate between the feeding points $A_1$ and $A_3$. The feeding points for the electrodes 3*b* are points $A_2$ and $A_4$, and the maximum voltage drop points in the electrode 3*b* are points $E_3$ and $E_4$ which are the ends of the electrode 3*b*, and a point $E_6$ which is a potentially intermediate between the feeding points $A_2$ and $A_4$.

In Embodiment 20, on the mirror base plate of glass was formed a chromium layer 0.02 μm thick by sputtering. On this chromium layer, a titanium layer is formed by sputtering to a thickness of 0.03 μm to use as a reflective heating resistor film, on which a silver thin film was formed by screen printing using silver paste. On this thin silver layer a copper thin film was deposited to form electrodes. A DC voltage of 12 V was applied between the feeding points $A_1$, $A_3$ and $A_2$, $A_4$. The current between the electrodes was 4.5 A.

In the mirror of this invention, although the temperature rise was slightly large at the electrode end portions, particularly near points $E_1$, $E_4$, the temperature of the mirror surface including those portions corresponding to the electrodes was able to be controlled in a range of 50–65° C. as set beforehand. The voltage drops between $A_1$ and $E_2$ and between $A_2$ and $E_3$ were less than 0.5% of the supply voltage but because the distances between $A_1$ and $E_2$ and between $A_2$ and $E_3$ were short, these portions were also evenly heated.

Measurements were made of voltage drops between the maximum voltage drop points in the mirror of Embodiments 15–20. The results of the measurement are shown in Table 1.

| | Voltage drop (V) (lower row: % of supply voltage) | | | | | |
|---|---|---|---|---|---|---|
| | $A_1$–$E_1$ | $A_1$–$E_2$ | $A_2$–$E_3$ | $A_2$–$A_4$ | $A_1$, $A_3$–$A_5$ | $A_2$, $A_4$–$A_6$ |
| Embodiment 15 | 2.0 | 1.6 | 1.4 | 2.2 | — | — |
| | 16.7 | 13.3 | 11.7 | 18.3 | — | — |
| Embodiment 16 | 0.9 | 0.5 | 0.6 | 0.8 | — | — |
| | 7.5 | 4.2 | 5.0 | 6.7 | — | — |
| Embodiment 17 | 0.6 | 0.2 | 0.3 | 0.7 | — | — |
| | 5.0 | 1.7 | 2.5 | 5.8 | — | — |
| Embodiment 18 | 0.3 | 0.2 | 0.1 | 0.3 | — | — |
| | 2.5 | 1.7 | 0.8 | 2.5 | — | — |
| Embodiment 19 | 0.2 | <0.05 | <0.05 | 0.2 | — | — |
| | 1.7 | <0.4 | <0.4 | 1.7 | — | — |

| | Voltage drop (V) (lower row: % of supply voltage) | | | | | |
|---|---|---|---|---|---|---|
| | $A_1$–$E_2$ | $A_3$–$E_1$ | $A_2$–$E_3$ | $A_4$–$E_4$ | $A_1$, $A_3$–$E_5$ | $A_2$, $A_4$–$E_6$ |
| Embodiment 20 | <0.05 | 0.1 | <0.05 | 0.09 | 0.08 | 0.07 |
| | <0.4 | 0.8 | <0.4 | 0.8 | 0.7 | 0.6 |

The following Embodiments 21–26 are examples where the sheet resistivity of the heating resistor film is distributed in such a way that the portions of the heating resistor film which have been difficult to heat in the conventional mirror have small sheet resistivities, thereby passing a greater amount of heating current through these portions, enhancing the amount of heat generated and realizing an efficient heating of the entire surface of the mirror base plate.

Embodiment 21

Figure 14:
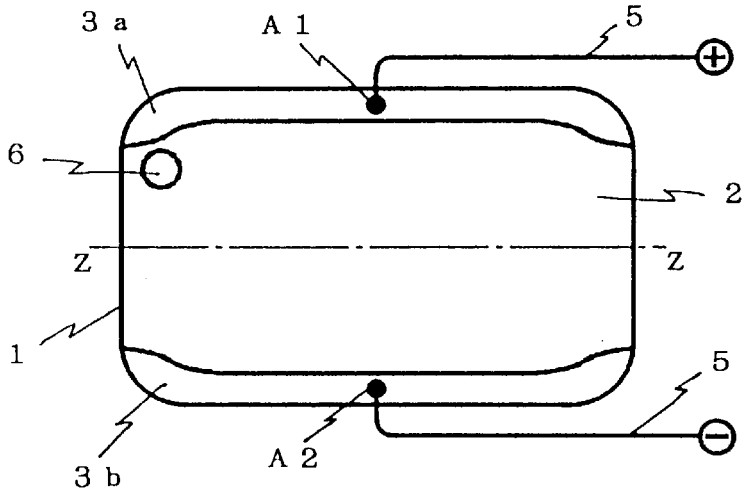
FIG. 14 is a schematic perspective view showing the back of a twenty-first embodiment.

FIG. 14 is a schematic perspective view showing the back of a mirror with a heater used as a vehicle door mirror. Reference numeral 1 represents a mirror base plate made of a transparent material such as glass.

On the back of the mirror base plate 1 is formed a reflective heating resistor film 2 having an uneven sheet resistivity distribution in the surface. The ununiform distribution of sheet resistivity in the heating resistor film may be such that the sheet resistivity is maximum at the central part of the mirror base plate and minimum near the short sides, or conversely it is minimum at the central part and minimum near the sides. It should be noted that the positions where the sheet resistivity becomes maximum or minimum are not limited to the central part or side parts of the mirror base plate but may be other positions within the mirror base plate.

That is, the areas in the mirror base plate where the sheet resistivity is maximum or minimum are set so that portions of the mirror base plate whose temperature, in an even sheet resistivity distribution, would easily rise have large resistances and that portions of the mirror base plate whose temperature, in an even sheet resistivity distribution, would hardly rise have small resistances, thereby permitting quick and uniform heating of the entire surface of the mirror base plate.

A variety of methods can be employed to give the heating resistor film an uneven sheet resistivity distribution. For example, the thickness of the heating resistor film may be changed or a plurality of materials with different resistances may be used to form a mosaic-like heating resistor film.

Figure 15:
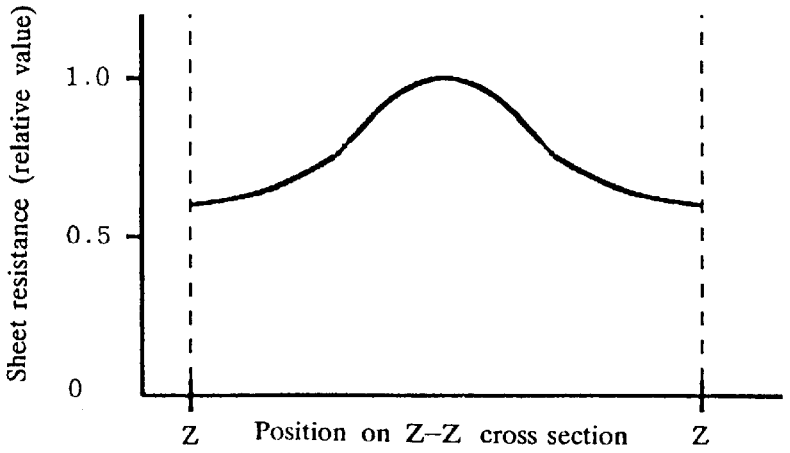
FIG. 15 is a sheet resistance distribution diagram of the twenty-first embodiment.

In Embodiment 21, titanium is deposited on a generally rectangular mirror base plate 1 of glass by magnetron sputtering to form a reflective heating resistor film 2 with a sheet resistivity distribution such that the sheet resistivity is smaller at peripheral portions of the mirror base plate 1 than at the central portion. The reflective heating resistor film 2 of titanium is formed by a magnetron sputtering technique in which a target (cathode) and a mirror base plate 1 are arranged so that an erosion area where the film is formed at a maximum speed corresponds to the peripheral portion of the mirror base plate 1, and the distance between the mirror base plate 1 and the cathode is small. The thickness of the central portion of the mirror base plate 1 is therefore smaller than that of the peripheral portion. The distribution of the sheet resistivity in the reflective heating resistor film 2 of titanium is shown in FIG. 15. The sheet resistivity of the central part was about 1.7 times higher than that of the peripheral part. The sheet resistivity is measured by a four-probe method and the values are converted into relative values to draw the curve.

Copper thin layers were formed along the long sides of the mirror base plate 1, thus providing a pair of opposing electrodes 3. Lead wires 5 are connected to the current feeding points $A_1$, $A_2$ on the electrode wires 3*a*, 3*b* of the electrodes 3. In this way a mirror with a heater was fabricated.

The heating of this mirror was controlled by a temperature control element (thermostat) 6. The surface temperature of the mirror base plate 1 including the peripheral portions was able to be controlled in a 50–65° C. range as set beforehand.

Embodiment 22

Figure 16:
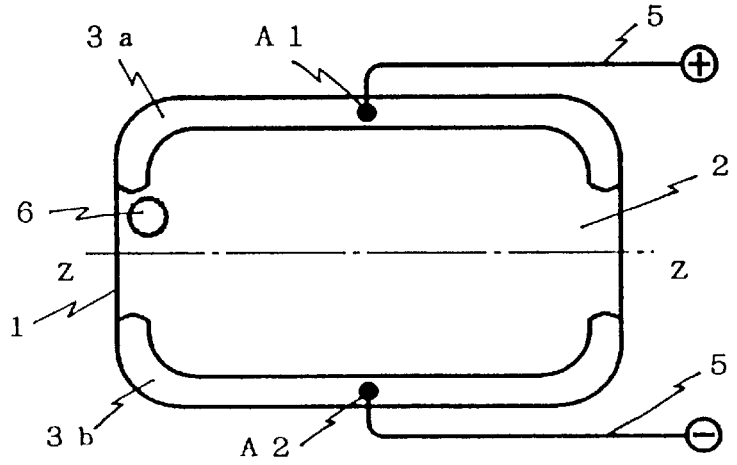
FIG. 16 is a schematic perspective view showing the back of a twenty-second embodiment.
Figure 17:
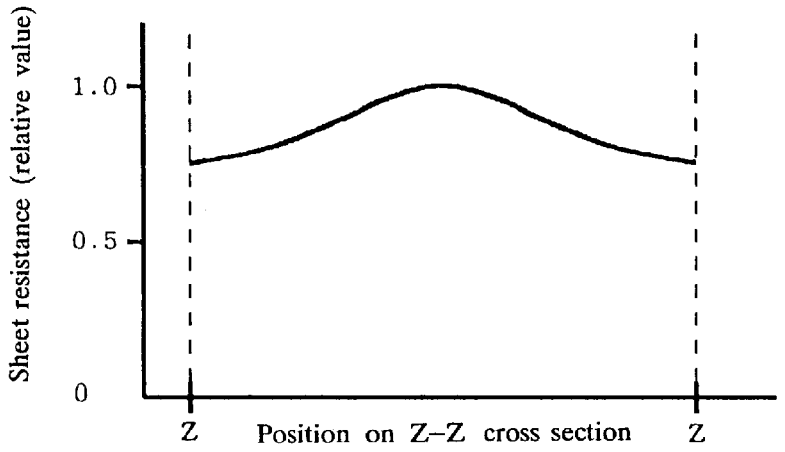
FIG. 17 is a sheet resistance distribution diagram of the twenty-second embodiment.

FIG. 16 shows a mirror of Embodiment 22. The mirror of Embodiment 22 is similar to Embodiment 21, except that the difference in the sheet resistivity between the central part and the peripheral part of the reflective heating resistor film 2 of titanium is smaller than that of Embodiment 21 and that the electrodes 3*a*, 3*b* are so arranged that the interval between their ends is narrower than the interval between their central portions than that of Embodiment 21. The distribution of the sheet resistivity in the reflective heating resistor film 2 of titanium is as shown in FIG. 17, in which the sheet resistivity at the central part is about 1.4 times higher than that of the peripheral part.

The heating of this heater-incorporated mirror was controlled by a temperature control element (thermostat) 6. The surface temperature of the mirror base plate 1 including the peripheral portions was able to be controlled in a range of 50–65° C. as set beforehand.

Embodiment 23

Figure 18:
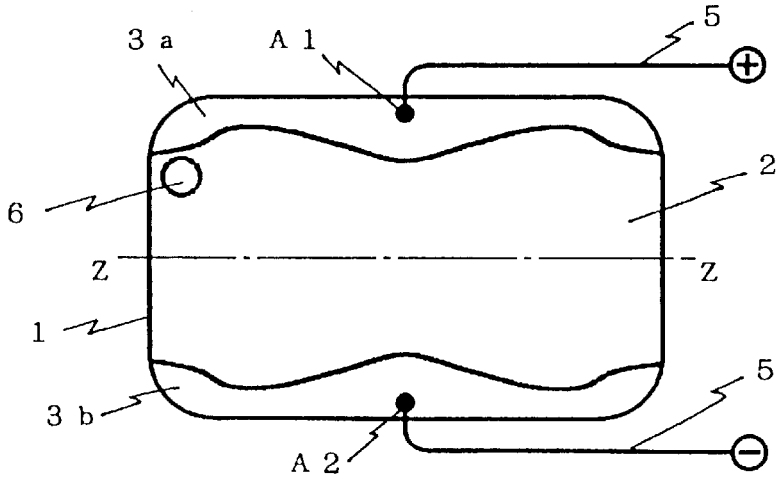
FIG. 18 is a schematic perspective view showing the back of a twenty-third embodiment.
Figure 19:
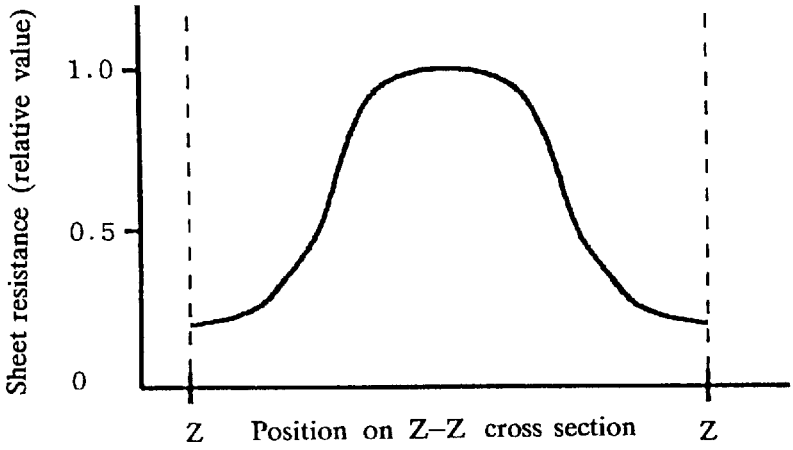
FIG. 19 is a sheet resistance distribution diagram of the twenty-third embodiment.

FIG. 18 shows a mirror of Embodiment 23. A mirror with a heater of Embodiment 23 is similar to Embodiment 21, except that the difference in the sheet resistivity between the central part and the peripheral part of the reflective heating resistor film 2 of titanium is larger than that of Embodiment 21, and the electrodes 3*a*, 3*b* are provided with projection at their central portions. The distribution of the sheet resistivity in the reflective heating resistor film 2 of titanium is shown in FIG. 19, as shown in which the sheet resistivity at the central part was about 5.0 times higher than that of the peripheral part.

The heating of this mirror was controlled by a temperature control element (thermostat) 6. The surface temperature of the mirror base plate 1 including the peripheral portions was able to be controlled in a range of 50–65° C. as set beforehand.

Embodiment 24

Figure 20:
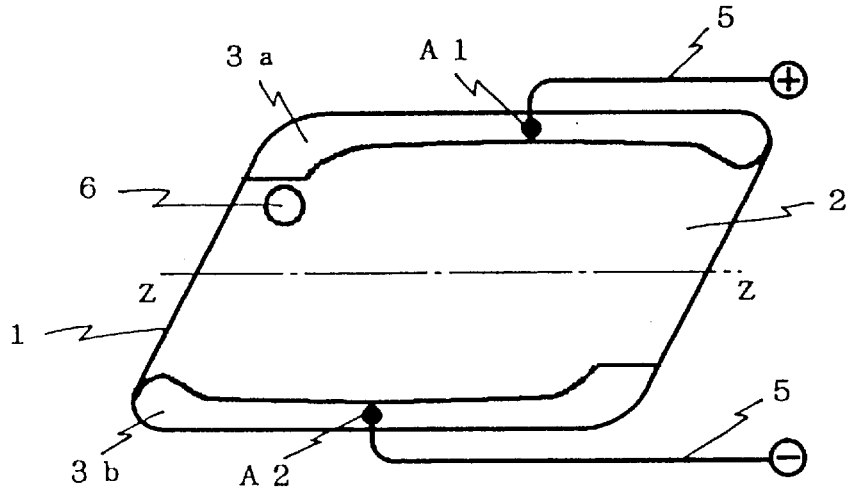
FIG. 20 is a schematic perspective view showing the back of a twenty-fourth embodiment.
Figure 21:
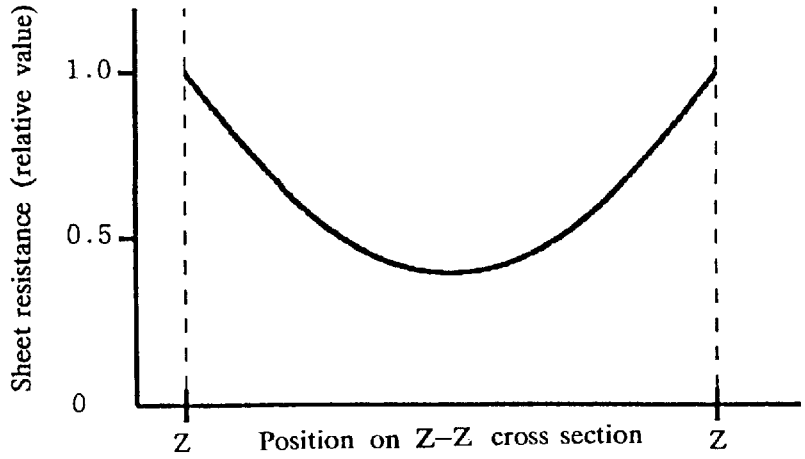
FIG. 21 is a sheet resistance distribution diagram of the twenty-fourth embodiment.

FIG. 20 shows a mirror of Embodiment 24. Embodiment 24 has a titanium film deposited on the generally parallelogram-shaped mirror base plate 1 of glass by sputtering to form a reflective heating resistor film 2 with a sheet resistivity distribution such that the sheet resistivity is smaller at central portion of the mirror base plate 1 than at the peripheral portions. The reflective heating resistor film 2 of titanium was formed by sputtering in which a target (cathode) of a size comparatively small for the size of the mirror base plate 1 was used and the target was so placed that the central portion of the target corresponds to the central portion of the mirror base plate 1. The thickness of the central portion of the mirror base plate 1 is therefore greater than that of the peripheral portion. The distribution of the sheet resistivity in the reflective heating resistor film 2 of titanium is shown in FIG. 21, as shown in which the sheet resistivity of the peripheral portions was about 2.5 times higher than that of the central part.

A copper paste was used to form a thin copper layer by screen-printing on the long sides of the mirror base plate 1, thus providing a pair of opposing electrodes 3. Lead wires 5 were connected to the current feeding points $A_1$, $A_2$ on the electrode wires 3*a*, 3*b* of the electrodes 3. In this way the mirror was fabricated.

The heating of this mirror was controlled by a temperature control element (thermostat) 6. The surface temperature of the mirror base plate 1 including the peripheral portions was able to be controlled in a range of 50–65° C. as set beforehand.

Embodiment 25

Figure 22:
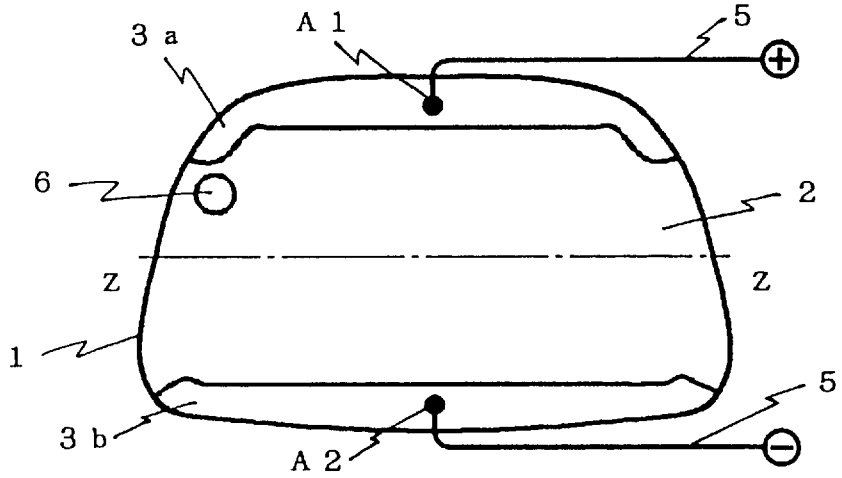
FIG. 22 is a schematic perspective view showing the back of a twenty-fifth embodiment.
Figure 23:
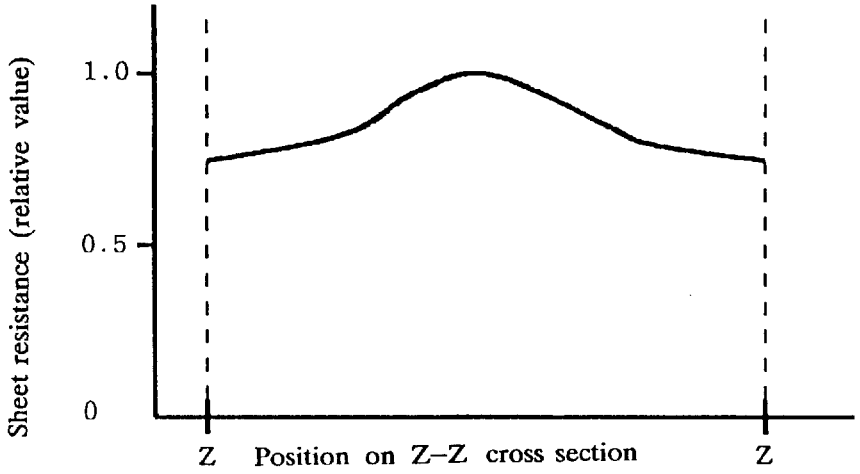
FIG. 23 is a sheet resistance distribution diagram of the twenty-fifth embodiment.

FIG. 22 shows a mirror of Embodiment 25. Embodiment 24 has a titanium film formed by sputtering on the back of glass mirror base plate 1, a part of a 300 mm-radius sphere, to form a reflective heating resistor film 2 with a sheet resistivity distribution such that the sheet resistivity is smaller at peripheral portions of the mirror base plate 1 than at the central portion. In a sputtering method in which a target and a base plate carrier were disposed parallel to each other, the reflective heating resistor film 2 of titanium was formed by parallelly moving the mirror base plate 1, utilizing the positional difference that the distance between the peripheral portion of the mirror base plate 1 and the cathode was substantially smaller than the distance between the central portion of the mirror base plate 1 and the cathode. The thickness of the central portion of the mirror base plate 1 was smaller than those the peripheral portions. The distribution of the sheet resistivity in the reflective heating resistor film 2 of titanium is shown in FIG. 23. The sheet resistivity of the peripheral portions was about 1.3 times higher than that of the central part.

A copper paste was used to form a thin copper layer by screen printing on the long sides of the mirror base plate 1, thus providing a pair of opposing electrodes 3. Lead wires 5 were connected to the current feeding points $A_1$, $A_2$ on the electrode wires 3*a*, 3*b* of the electrodes 3. In this way the heater-incorporated mirror was fabricated.

The heating of this mirror was controlled by a temperature control element (thermostat) 6. The surface temperature of the mirror base plate 1 including the peripheral portions was able to be controlled in a range of 50–65° C. as set beforehand.

Embodiment 26

Figure 24:
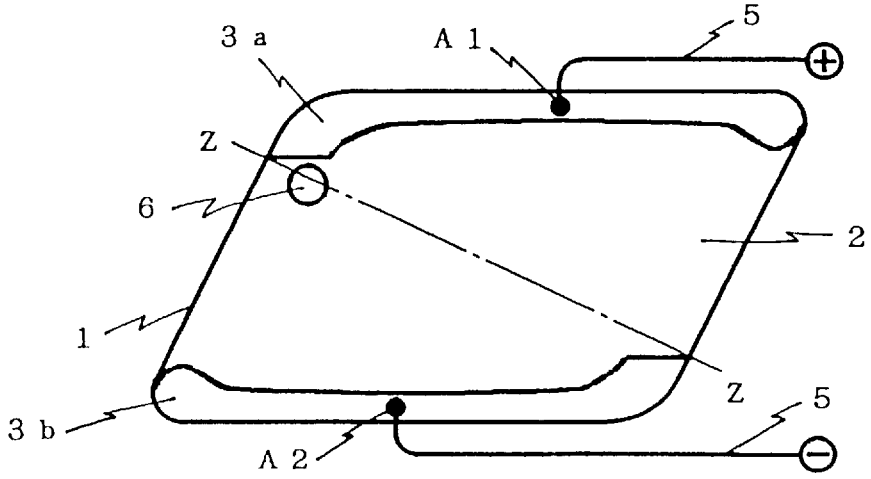
FIG. 24 is a schematic perspective view showing the back of a twenty-sixth embodiment.
Figure 25:
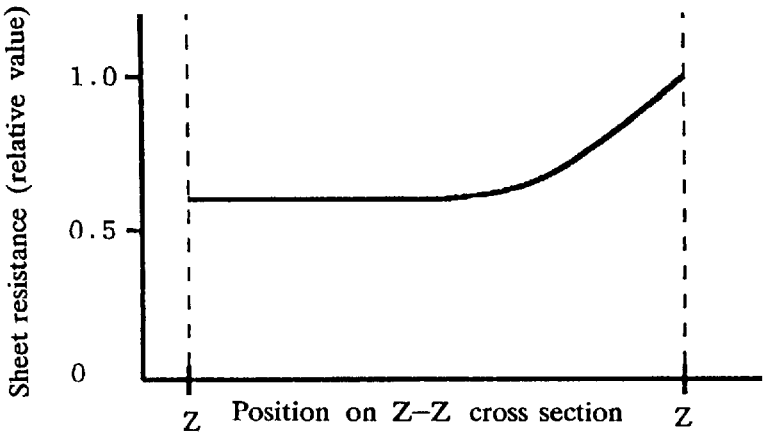
FIG. 25 is a sheet resistance distribution diagram of the twenty-sixth embodiment.

FIG. 24 shows a mirror of Embodiment 26. Embodiment 26 was manufactured in the same way as of embodiment 24, except that the reflective heating resistor film 2 of titanium was so formed that its upper left portion had a lower sheet resistivity than the lower right portion. In the sputtering process to form the reflective heating resistor film 2 of titanium, the center of the target was so arranged as to correspond to the upper left portion of the mirror base plate 1. The thickness of the lower right portion of the reflective heating resistor film 2 was smaller than that of the upper left portion. The distribution of the sheet resistivity in the reflective heating resistor film 2 of titanium is shown in FIG. 25. As shown in FIG. 25 the sheet resistivity at the lower right portion was about 1.7 times higher than that of the upper left portion.

The heating of this mirror was controlled by a temperature control element (thermostat) 6 placed at a wide angle portion of the mirror base plate 1 where the sheet resistivity is low. The surface temperature of the mirror base plate 1 including the peripheral portions was able to be controlled in a range of 55–65° C. as set beforehand.

The mirror of Embodiment 26 had a low sheet resistivity at a wide angle portion of the mirror base plate, which was easily heated, and had a temperature control element (thermostat) at this portion to prevent a reduction in temperature rise speed which would be caused by the thermal capacity of the temperature control element. At the same time, by increasing the sheet resistivity of another wide angle portion of the base plate, the temperature rise speed of this portion was limited. Because of the above steps taken, particularly uniform heating was realized.

In the following Embodiments 27–42, the voltage drop at the electrode ends on the narrow angle portion side with respect to the current feeding point of each electrode was smaller than the voltage drop at the electrode ends on the wide angle portion side in order to raise the voltage applied to the narrow angle portion, whose temperature had conventionally been difficult to raise, to a value substantially higher than the voltage applied to the wide angle portion, thereby facilitating and realizing an efficient, uniform heating of the entire surface of the mirror base plate.

Embodiment 27

Figure 26:
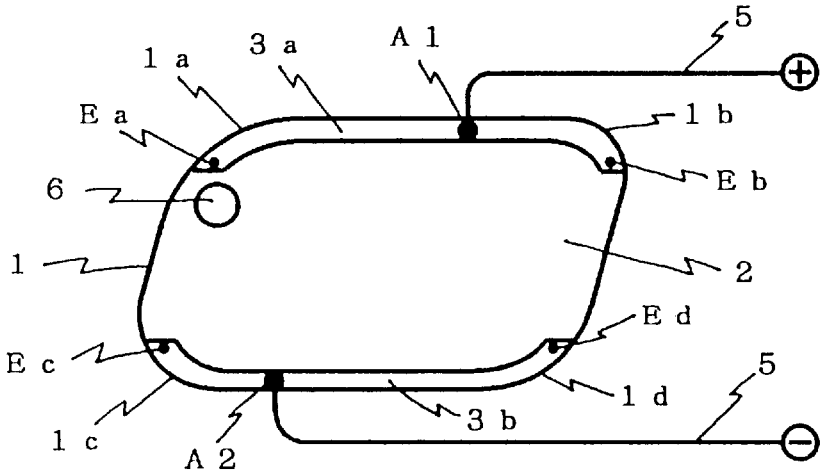
FIG. 26 is a schematic perspective view showing the back of twenty-seventh of thirty-third embodiments.

FIG. 26 is a schematic perspective view showing the back of a mirror with a heater used as a vehicle door mirror.

Reference numeral 1 is a generally parallelogram-shaped mirror base plate made of a transparent material such as glass. Out of the four rounded corners of the mirror base plate 1, two corners are narrow angle portions 1*b*, 1*c* whose interior angles defined by the sides of the mirror base plate 1 are small, and the other two are wide angle portions 1*a*, 1*d* with large interior angles. On the back of the mirror base plate 1 is formed a reflective heating resistor film 2.

The back of the reflective heating resistor film 2 is provided with a pair of opposing electrodes 3*a*, 3*b* that extends in two directions to the narrow and wide angle portions of the mirror base plate 1 to supply electricity to the reflective heating resistor film 2. These opposing electrodes 3*a*, 3*b* are so arranged that the distance between them is narrower near the ends than at the central portion in order to heat the side portions of the mirror. In the electrode 3*a*, Eb designates an electrode end on the narrow angle portion 1*b* side of the mirror base plate 1; and Ea designates an electrode end on the wide angle portion 1*a* side of the mirror base plate 1. In the electrode 3*b*, Ec designates an electrode end on the narrow angle portion 1*c* side of the mirror base plate 1; and Ed designates an electrode end on the wide angle portion 1*d* side of the mirror.

In the electrodes 3*a*, 3*b*, to make the voltage drop at the electrode ends Eb, Ec on the side of the narrow angle portions 1*b,* 1*c* of the mirror base plate 1 with respect to the feeding points A1, A2 lower than the voltage drop at the electrode ends Ea, Ed on the side of the wide angle portions 1*a,* 1*d,* the feeding points A1, A2 may, for example, be located on the narrow angle side with respect to the center of the electrodes 3*a*, 3*b*, or the electrodes on the narrow angle portions 1*b,* 1*c* sides with respect to the feeding points A1, A2 may be made wider or thicker than the electrodes on the wide angle portions 1*a,* 1*d* sides or may be formed of materials with lower resistivity than the electrodes on the side of the wide angle portions 1*a*, 1*d.*

In Embodiment 27, titanium was deposited by sputtering on the glass mirror base plate 1 to a thickness of 0.05 μm to form a reflective heating resistor film 2, on which a copper paste was applied by screen-printing to form electrodes 3 of a thin copper layer with an even resistance distribution. Lead wires 5 were connected to the feeding points A1, A2, which were located on the narrow angle portions 1*b,* 1*c* sides with respect to the center of the electrodes 3*a*, 3*b*. In this way, the mirror was fabricated. When a DC voltage of 12 V was applied between the feeding points A1 and A2, a current of 2.3 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0.35 V, 0.72 V, 0.34 V, and 0.75 V, respectively. The voltage drop at the narrow angle portion side electrode end of the mirror base plate with respect to the feeding point was smaller than the voltage drop at the wide angle portion side electrode end, and less than 50%.

The heating of the heater-incorporated mirror was controlled by a thermostat. Although the temperature near the narrow angle portion of the mirror base plate was slightly low, the mirror surface temperature was able to be controlled in a range of 45–65° C. according to the setting.

Embodiment 28

A mirror with a heater of this embodiment was fabricated in the same way as in Embodiment 27, except that the feeding points A1, A2 were located nearer to the narrow angle portion side electrode ends of the mirror base plate. When a DC voltage of 12 V was applied between the feeding points A1 and A2 of the mirror, a current of 2.2 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0.21 V, 1.1 V, 0.22 V, and 1.2 V, respectively. The voltage drop at the narrow angle portion side electrode end of the mirror base plate with respect to the feeding point was smaller than the voltage drop at the wide angle portion side electrode end, and less than 20%.

The heating of the heater-incorporated mirror was controlled by a thermostat. The temperature of the mirror surface including the areas near the narrow angle portions in the mirror base plate was able to be controlled in a range of 50–65° C. as set beforehand.

Embodiment 29

A mirror with a heater of this embodiment was fabricated in the same way as in Embodiment 27, except that the feeding points A1, A2 were located much nearer to on the narrow angle portion side electrode ends of the mirror base plate. When a DC voltage of 12 V was applied between the feeding points A1 and A2 of the mirror, a current of 2.1 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0.12 V, 1.3 V, 0.13 V, and 1.3 V, respectively. The voltage drop at the narrow angle portion side electrode end of the mirror base plate with respect to the feeding point was smaller than the voltage drop at the wide angle portion side electrode end, and less than 10%.

The heating of the mirror was controlled by a thermostat. The temperature of the mirror surface including the areas near the narrow angle portions in the mirror base plate was able to be controlled in a range of 50–60° C. as set beforehand.

Embodiment 30

A mirror with a heater of this embodiment was fabricated in the same way as in Embodiment 27, except that a titanium film was deposited to a thickness of 0.1 μm, and the electrodes of thin silver layer with a uniform resistance distribution were formed by screen-printing of silver paste. When a DC voltage of 12 V was applied between the feeding points A1 and A2 of the mirror, a current of 4.1 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0.11 V, 0.74 V, 0.10 V and 0.67 V, respectively. The voltage drop at the narrow angle portion side electrode end of the mirror base plate with respect to the feeding point was smaller than the voltage drop at the wide angle portion side electrode end, and less than 15%.

The heating of the mirror was controlled by a thermostat. The temperature of the mirror surface including the areas near the narrow angle portions in the mirror base plate was able to be controlled in a range of 50–65° C. as preset.

Embodiment 31

A mirror with a heater of this embodiment was fabricated In the same was as In Embodiment 30, except that the feeding points A1, A2 were located closer to the narrow angle portion side of the mirror base plate than in the case of Embodiment 30. When a DC voltage of 12 V was applied between the feeding points A1 and A2 of the mirror, a current of 4.0 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0.04 V, 0.87 V, 0.03 V and 0.92 V, respectively. The voltage drop at the narrow angle portion side electrode end of the mirror base plate with respect to the feeding point was smaller than the voltage drop at the wide angle portion side electrode end, and less than 5%.

The heating of the mirror was controlled by a thermostat. The temperature of the mirror surface including the areas near the narrow angle portions in the mirror base plate was able to be controlled in a range of 50–60° C. as set beforehand.

Embodiment 32

A mirror with a heater of this embodiment was fabricated in the same way as in Embodiment 27, except that the feeding points A1, A2 were located at the electrode ends on the narrow angle portion side. When a DC voltage of 12 V was applied between the feeding points A1 and A2 of the heater-incorporated mirror, a current of 2.0 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0 V, 1.3 V, 0 V and 1.3 V, respectively. The voltage drop at the narrow angle portion side electrode end of the mirror base plate with respect to the feeding point was smaller than the voltage fall at the wide angle portion side electrode end.

The heating of the heater-incorporated mirror was controlled by a thermostat. The temperature of the mirror surface including the areas near the narrow angle portions in the mirror base plate was able to be controlled in a range of 50–60° C. as set in advance.

Embodiment 33

A mirror with a heater of this embodiment was fabricated in the same way as in Embodiment 27, except that a nichrome film was formed by sputtering to a thickness of 0.2 μm to form a reflective heating resistor film 2, on which a silver paste was applied by screen-printing to form electrodes of thin silver layer, another thin silver layer was formed thick on the narrow angle portion side of the mirror base plate from the center, and the center of each electrode (at the boundary between the thick part and thin part of the thin silver layer) was made a feeding point. When a DC voltage of 12 V was applied between the feeding points A1 and A2 of the mirror, a current of 3.5 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0.05 V, 0.65 V, 0.06 V and 0.63 V, respectively. The voltage drop at the narrow angle portion side electrode end of the mirror base plate with respect to the feeding point was smaller than the voltage drop at the wide angle portion side electrode end, and less than 10%.

The heating of the mirror was controlled by a thermostat. The temperature of the mirror surface including the areas near the narrow angle portions in the mirror base plate was able to be controlled in a range of 50–60° C. as set in advance.

Embodiment 34

Figure 27:
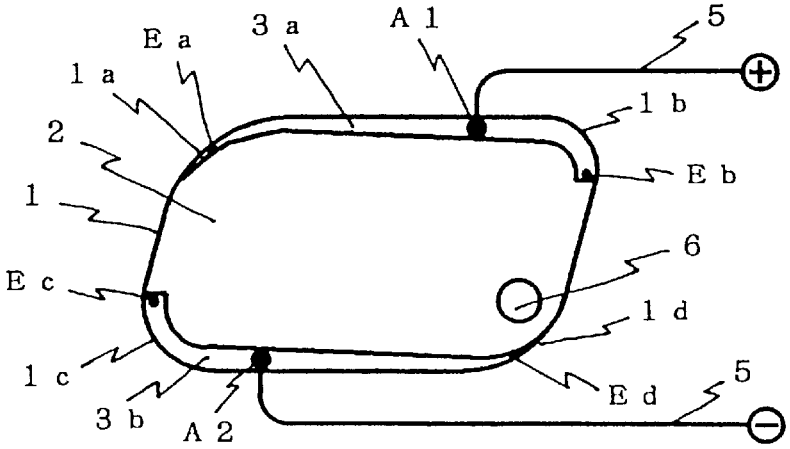
FIG. 27 is a schematic perspective view showing the back of a thirty-fourth embodiment.

In the vehicle door mirror shown in FIG. 27, chromium and titanium were deposited sequentially by sputtering over a glass mirror base plate 1 to a thickness of 0.05 μm each to form a reflective heating resistor film 2, on which silver and copper pastes were applied by screen-printing to form a two-layer thin film to form silver and copper layers as electrodes 3. The portions of the two-layer thin film extending to the narrow angle portions 1*b*, 1*c* of the mirror base plate 1 had a greater width than the portions extending to the wide angle portions 1*a*, 1*d*. Current feeding points A1, A2 were located on the narrow angle portions 1*b*, 1*c* sides from the center of the electrodes 3*a*, 3*b* and these feeding points A1, A2 were connected with lead wires 5. In this way, the mirror was manufactured. When a DC voltage of 12 V was applied between the feeding points A1 and A2 of the mirror, a current of 2.7 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were. 0.05 V, 0.17 V, 0.05 V and 0.19 V, respectively. The voltage drop at the narrow angle portion side electrode end of the mirror base plate with respect to the feeding point was smaller than the voltage drop at the wide angle portion side electrode end, and less than 30%.

The heating of the mirror was controlled by a thermostat. Although the temperature near the narrow angle portions of the mirror base plate was slightly low, the temperature of the mirror surface was able to be controlled in a range of 45–60° C. as set beforehand.

Embodiment 35

Figure 28:
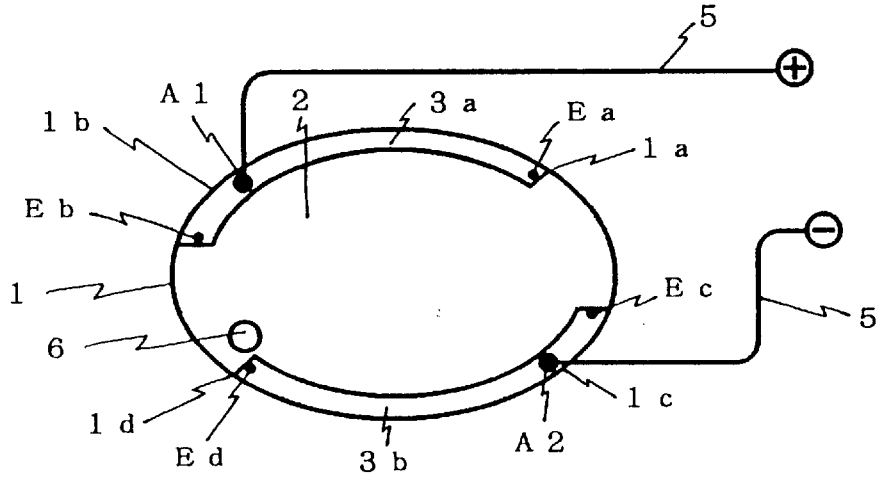
FIG. 28 is a schematic perspective view showing the back of a thirty-fifth embodiment.

In the vehicle door mirror shown in FIG. 28, titanium was deposited by sputtering over a generally oval glass mirror base plate 1 to a thickness of 0.1 μm to form a reflective heating resistor film 2, on which silver and copper pastes were applied by screen-printing to form a two-layer thin film consisting of silver and copper layers with an even resistance distribution. The two-layer thin film served as electrodes 3. Current feeding points A1, A2 were located on the narrow angle portions 1*b*, 1*c* sides from the center of each electrode 3*a*, 3*b* and these feeding points A1, A2 were connected with lead wires 5. In this way, the mirror was manufactured. when a DC voltage of 12 V was applied between the feeding points A1 and A2 of the heater-incorporated mirror, a current of 3.1 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0.08 V, 0.57 V, 0.08 V and 0.55 V, respectively. The voltage drop at the narrow angle portion side electrode end of the mirror base plate with respect to the feeding point was smaller than the voltage drop at the wide angle portion side electrode end, and less than 15%.

The heating of the mirror was controlled by a thermostat. The temperature of the mirror surface including areas near the narrow angle portions of the mirror base plate was able to be controlled in a range of 50–65° C. as preset.

Embodiment 36

Figure 29:
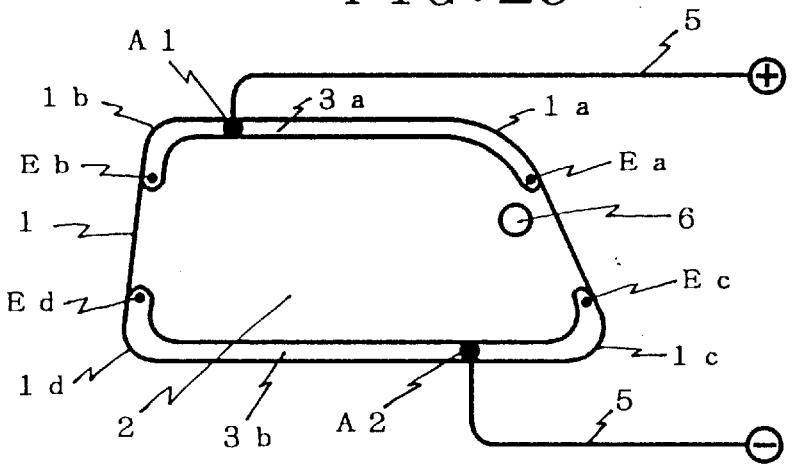
FIG. 29 is a schematic perspective view showing the back of a thirty-sixth embodiment.

In the vehicle door mirror shown in FIG. 29, titanium was deposited by sputtering over a generally trapezoidal glass mirror base plate 1 to a thickness of 0.1 μm to form a reflective heating resistor film 2, on which silver and copper pastes were applied by screen-printing to form a two-layer thin film consisting of silver and copper layers with an even resistance distribution. The two-layer thin film were used as electrodes 3. Current feeding points A1, A2 were located on the narrow angle portions 1*b*, 1*c* sides from the center of each electrode 3*a*, 3*b* and these feeding points A1, A2 were connected with lead wires 5. In this way, the mirror was manufactured. When a DC voltage of 12 V was applied between the feeding points A1 and A2 of the mirror, a current of 4.5 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0.11 V, 0.94 V, 0.13 V and 0.87 V, respectively. The voltage drop at the narrow angle portion side electrode end of the mirror base plate with respect to the feeding point was smaller than the voltage drop at the wide angle portion side electrode end, and less than 15%.

The heating of the mirror was controlled by a thermostat. The temperature of the mirror surface including areas of narrow angle portions of the mirror base plate was able to be controlled in a range of 50–60° C. as set in advance.

Embodiment 37

Figure 30:
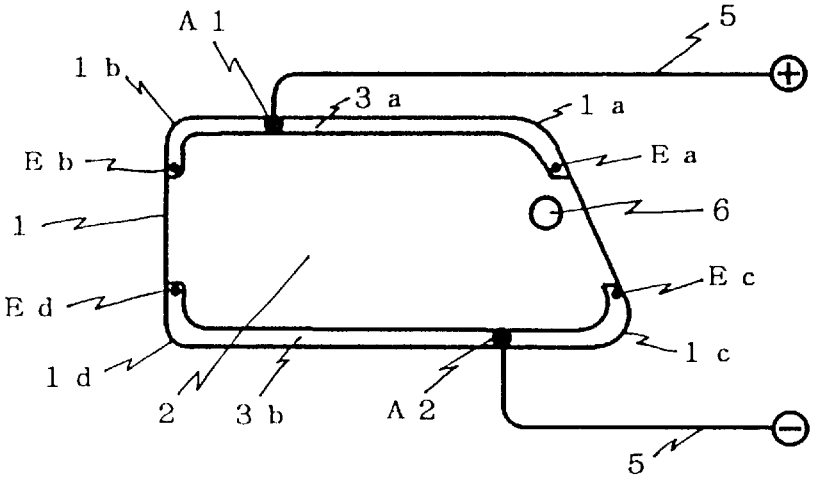
FIG. 30 is a schematic perspective view showing the back of a thirty-seventh embodiment.

In the vehicle door mirror shown in FIG. 30, titanium was deposited by sputtering over a generally trapezoidal glass mirror base plate 1, which had a slanted leg on only one side, to a thickness of 0.1 μm to form a reflective heating resistor film 2, on which silver and copper pastes were applied by screen-printing to form a two-layer thin film consisting of silver and copper layers with an even resistance distribution. The two-layer thin film served as electrodes 3. Current feeding points A1, A2 were located on the narrow angle portions 1*b*, 1*c* sides from the center of each electrode 3*a*, 3*b* and these feeding points A1, A2 were connected with lead wires 5. In this way, the mirror was manufactured. When a DC voltage of 12 V was applied between the feeding points A1 and A2 of the mirror, a current of 4.3 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0.17 V, 0.88 V, 0.15 V and 0.90 V, respectively. The voltage drop at the narrow angle portion side electrode end of the mirror base plate with respect to the feeding point was smaller than the voltage drop at the wide angle portion side electrode end, and less than 20%.

The heating of the heater-incorporated mirror was controlled by a thermostat. The temperature of the mirror surface including areas of narrow angle portions of the mirror base plate was able to be controlled in a range of 50–60° C. as set in advance.

Embodiment 38

Figure 31:
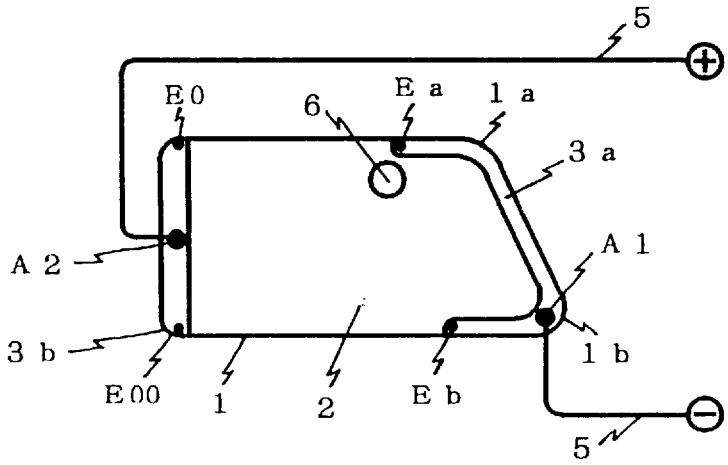
FIG. 31 is a schematic perspective view showing the back of a thirty-eighth embodiment.

In the vehicle door mirror shown in FIG. 31, titanium was deposited by sputtering over a generally trapezoidal glass mirror base plate 1, which had a slanted leg on only one side, to a thickness of 0.1 μm to form a reflective heating resistor film 2. Along the slanted leg of the mirror base plate 1 and the other leg facing it are applied silver and copper pastes by screen-printing to form a two-layer thin film consisting of silver and copper layers with an even resistance distribution. The two-layer thin film were used as electrodes 3. A current feeding point A1 was located on the narrow angle portion 1*b* side from the center of the electrode 3*a* and another feeding point A2 was located at the center of the electrode 3*b* (a potentially middle point; the voltage drop between A2 and E0 and the voltage drop between A2 and E00 are equal). These feeding points A1, A2 were connected with lead wires 5. In this way, the mirror was manufactured. When a DC voltage of 12 V was applied between the feeding points A1 and A2 of the mirror, a current of 3.1 A flowed. At this time, the voltage drops between the feeding point A1 and the narrow angle portion side electrode end Eb, between the feeding point A1 and the wide angle portion side electrode end Ea, between the feeding point A2 and the electrode end E0, and between the feeding point A2 and the wide angle portion side electrode end E00 were 0.05 V, 0.51 V, 0.26 V and 0.26 V, respectively. The voltage drop at the narrow angle portion side electrode end of the mirror base plate with respect to the feeding point was smaller than the voltage drop at the wide angle portion side electrode end, and less than 10%.

The heating of the mirror was controlled by a thermostat. The temperature of the mirror surface including the areas near the narrow angle portions of the mirror base plate was able to be controlled in the range of 50–65° C. as set beforehand.

Embodiment 39

Figure 32:
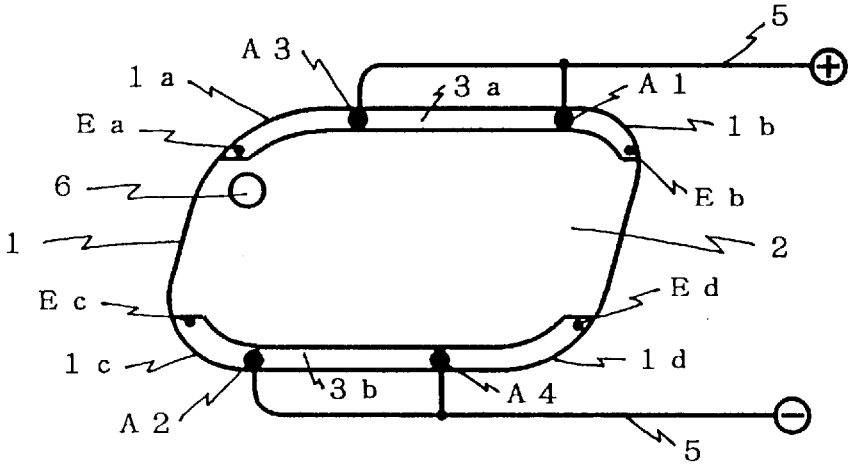
FIG. 32 is a schematic perspective view showing the back of a thirty-ninth embodiment.

In the vehicle door mirror shown in FIG. 32, chromium and titanium were deposited by sputtering over a glass mirror base plate 1 to thicknesses of 0.02 μm and 0.03 μm, respectively, to form a reflective heating resistor film 2, on which silver and copper pastes were applied by screen-printing to form a two-layer thin film consisting of silver and copper layers. The two-layer thin film served as electrodes 3. Current feeding points A1, A3 and A2, A4 on the electrodes 3*a*, 3*b* were connected with lead wires 5. In this way, the mirror was manufactured. When a DC voltage of 12 V was applied between the feeding points A1, A3 and A2, A4 of the mirror, a current of 4.2 A flowed. At this time, the voltage drops between the feeding point A1 and the narrow angle portion side electrode end Eb, between the feeding point A3 and the wide angle portion side electrode end Ea, between the feeding point A2 and the narrow angle portion side electrode end Ec, and between the feeding point A4 and the wide angle portion side electrode end Ed were 0.15 V, 0.82 V, 014 V and 0.81 V, respectively. The voltage drop at the narrow angle portion side electrode end of the mirror base plate with respect to the feeding point was smaller than the voltage drop at the wide angle portion side electrode end, and less than 20%.

The heating of the mirror was controlled by a thermostat. The temperature of the surface including the areas near the narrow angle portions of the mirror base plate was able to be controlled in a range of 50–65° C. as set beforehand.

Embodiment 40

Figure 33:
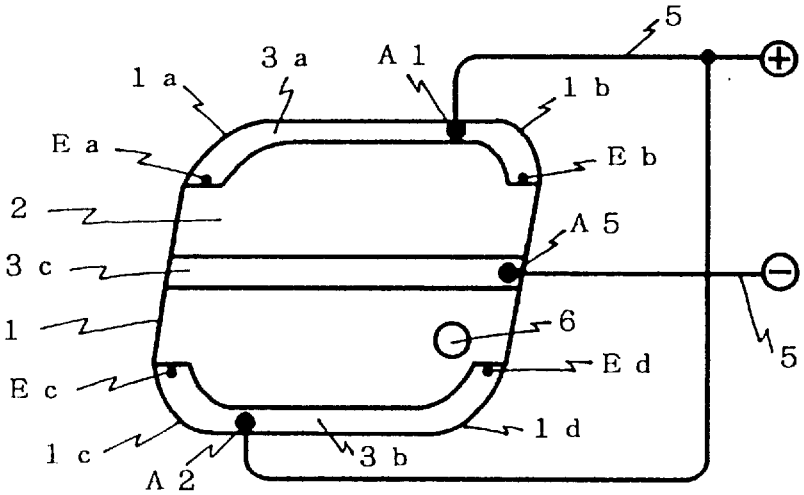
FIG. 33 is a schematic perspective view showing the back of a fortieth embodiment.

In the vehicle door mirror shown in FIG. 33, titanium was deposited over a glass mirror base plate 1 to a thickness of 0.1 μm to form a reflective heating resistor film 2, on which silver and copper pastes were applied by screen-printing to form a two-layer thin film consisting of silver and copper layers with an even resistance distribution. The two-layer thin film were used as electrodes 3*a*, 3*b*. A central wide electrode 3*c* was further formed by applying solder thick. These three wires used as electrodes 3. Current feeding points A1, A2 located on the narrow angle portions 1*b*, 1*c* sides from the centers of the electrodes 3*a*, 3*b* were connected with lead wires 5. Further, an end of the electrode 3*c* was also connected with a lead wire 5 (because there was substantially no voltage drop in the electrode 3*c*, a feeding point A5 can be set at an arbitrary position on this electrode). In this way, the mirror was manufactured. When a DC voltage of 12 V was applied between the feeding points A1, A2 and A5 of the mirror, a current of 4.7 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0.21 V, 0.74 V, 0.22 V and 0.76 V, respectively. The voltage drop at the narrow angle portion side electrode end of the mirror base plate with respect to the feeding point was smaller than the voltage drop at the wide angle portion side electrode end, and less than 30%.

The heating of the heater-incorporated mirror was controlled by a thermostat. Although the temperature near the narrow angle portions of the mirror base plate was slightly low, the temperature of the mirror surface was able to be controlled in a range of 45–65° C. as set in advance.

Embodiment 41

Figure 34:
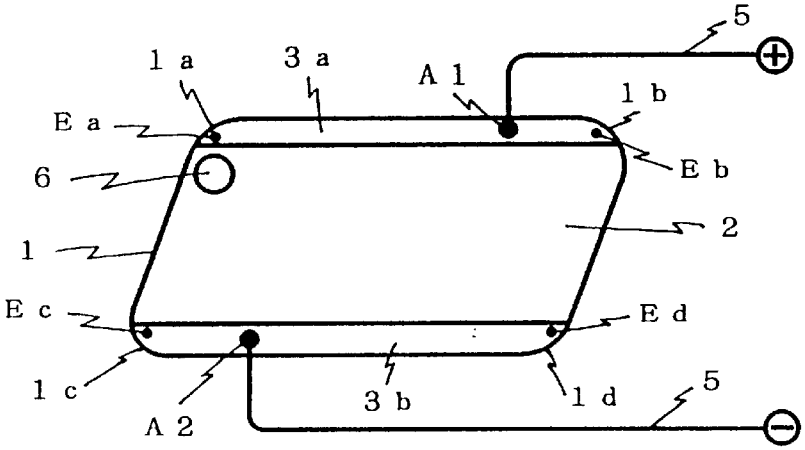
FIG. 34 is a schematic perspective view showing the back of a forty-first embodiment.

In the vehicle door mirror shown in FIG. 34, titanium was deposited over a glass mirror base plate 1 to a thickness of 0.15 μm to form a reflective heating resistor film 2, on which silver and copper pastes were applied by screen-printing to form a two-layer thin film consisting of silver and copper layers with an even resistance distribution. The two-layer thin film were used as electrodes 3. Current feeding points A1, A2 located on the narrow angle portions 1*b*, 1*c* sides from the centers of the electrodes 3*a*, 3*b* were connected with lead wires 5. In this way, the mirror was fabricated. When a DC voltage of 12 V was applied between the feeding points A1 and A2, a current of 3.7 a flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0.11 V, 0.51 V, 0.13 V and 0.48 V, respectively. The voltage drop at the narrow angle portion side electrode end of the mirror base plate with respect to the feeding point was smaller than the voltage drop at the wide angle portion side electrode end, and less than 30%.

The heating of the mirror was controlled by a thermostat. Although the temperature near the narrow angle portions of the mirror base plate was slightly low, the temperature of the mirror surface was able to be controlled in a range of 45–65° C. as set beforehand.

Embodiment 42

Figure 35:
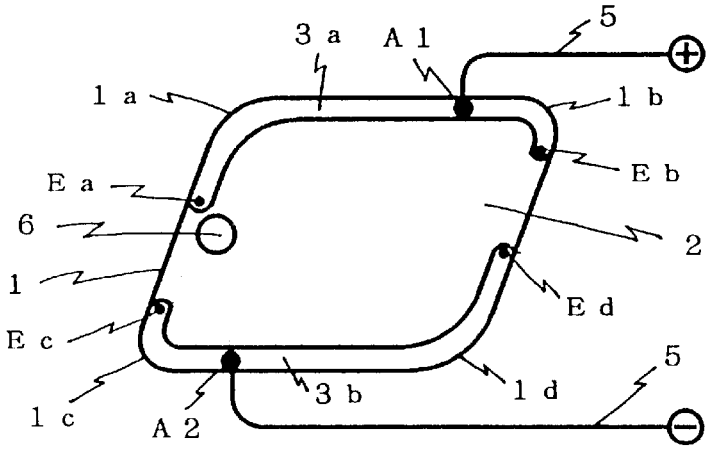
FIG. 35 is a schematic perspective view showing the back of a forty-second embodiment.

In the vehicle door mirror shown in FIG. 35, titanium was deposited over a glass mirror base plate 1 to a thickness of 0.2 μm to form a reflective heating resistor film 2, on which a copper paste was applied by screen-printing to form electrodes 3 of a thin copper film with an even resistance distribution. Current feeding points A1, A2 located on the narrow angle portions 1*b*, 1*c* sides from the centers of the electrodes 3*a*, 3*b* were connected with lead wires 5. In this way, the mirror was fabricated. When a DC voltage of 12 V was applied between the feeding points A1 and A2, a current of 2.9 A flowed. At this time, the voltage drops between the feeding point A1 and the narrow angle portion side electrode end Eb, between the feeding point A1 and the wide angle portion side electrode end Ea, between the feeding point A2 and the narrow angle portion side electrode end Ec, and between the feeding point A2 and the wide angle portion side electrode end Ed were 0.46 V, 1.3 V, 0.51 V and 1.4 V, respectively. The voltage drop at the narrow angle portion side electrode end of the mirror base plate with respect to the feeding point was smaller than the voltage drop at the wide angle portion side electrode end, and less than 40%.

The heating of the mirror was controlled by a thermostat. Although the temperature near the narrow angle portions of the mirror base plate was slightly low, the temperature of the mirror surface was able to be controlled in a range of 45–65° C. as set beforehand.

The following embodiments 43 through 52 are examples where the entire surface of the mirror base plate is heated uniformly by limiting the current concentration on the wide angle portion side of the opposing electrodes.

Embodiment 43

Figure 36:
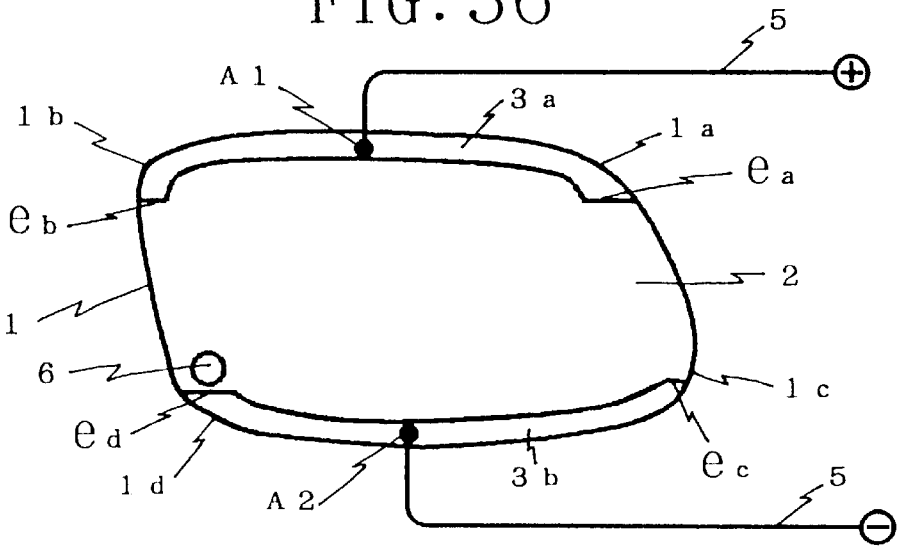
FIG. 36 is a rear view of a forty-third embodiment.

FIG. 36 shows the back of a mirror with a heater used as a vehicle door mirror.

Reference numeral 1 represents a generally parallelogram-shaped mirror base plate made of a transparent material such as glass. Out of the four rounded corners of the mirror base plate 1, two corners are wide angle portions 1*a*, 1*d* whose interior angles defined by edges of the mirror base plate 1 are large, and the other two corners are narrow angle portions 1*b*, 1*c* with smaller interior angles. On the back of the mirror base plate 1 is formed a reflective heating resistor film 2.

The back of the reflective heating resistor film 2 is also provided with electrodes 3*a*, 3*b* to apply electricity to the film 2. These electrodes 3*a*, 3*b* extend in two directions toward the narrow and wide angle portions of the mirror base plate 1.

The opposing electrode 3*a*, 3*b* are provided with projections at the corners, namely, wide and narrow angle portions to narrow the intervals between the electrodes at and near the short side portions than that at the central portion so as to Improve the heating of the short side portions of the mirror base plate 1. A projection ea on the wide angle portion side and a projection eb on the narrow angle portion side of the electrode 3*a* face a projection ec on the narrow angle portion side and projection ed on the wide angle portion side, respectively. The projections ea, ed on the wide angle portion sides are so shaped as to limit the current concentration at the wide angle portions.

A variety of ways are usable for limiting current concentrations on the wide angle portion side projections. Some examples will be described below.

(1) Projections are formed on the wide angle portion sides, and not on the opposing narrow angle portion sides.

(2) When projections are formed on the wide angle portion sides and the narrow angle portion sides and when the ends of the projections are linear, the current is more likely to concentrate on the ends as the widths of the ends become narrow. Hence, by making the widths of the projections formed at the electrode were ends on the wide angle portion sides wider than the widths of the projections formed at the opposing electrode ends on the narrow angle portion sides, it is possible to limit the current concentration on the wide angle portions.

(3) When projections are formed on the wide angle portion sides and the narrow angle portion sides opposing the wide angle portion sides and when the ends of the projections are curved, the current concentration becomes intense as the radius of the arc of the curve becomes small. Hence, by making the radii of the projections formed at the electrode ends on the wide angle portion sides larger than the radii of the projections formed at the electrode ends on the narrow angle portion sides, it is possible to suppress the current concentration on the wide angle portions.

(4) When the radii of the projections on the wide angle portion sides and the opposing narrow angle portions sides are equal, the current concentration becomes small as the distance from the end surface of the mirror base plate to the inflection point (vertex) increases. Therefore, by making the lengths from the end surface to the vert of the projection formed at the electrode end on the wide angle portion side larger than the length of the projection formed at the opposing electrode end on the narrow angle portion side, it is possible to suppress the current concentration on the wide angle portion side.

With the electrode ends shaped as described above, the concentration of currents flowing into the wide angle portions, which are easily heated, can be reduced, permitting uniform heating of the entire surface of the mirror.

In Embodiment 43, a titanium film was formed by sputtering on a generally parallelogram-shaped curved-surface glass mirror base plate 1 (R=1,400 mm) to a thickness of 0.1 μm to form a reflective heating resistor film 2.

Further, the back of the reflective heating resistor film 2 was provided with electrodes 3*a*, 3*b* to apply electricity to the film 2. The electrodes 3*a*, 3*b* extended in both directions to the narrow angle portions and the wide angle portions of the mirror base plate 1.

Current feeding points A1, A2 on the electrodes 3*a*, 3*b* were connected with lead wires 5, thus fabricating the heater-incorporated mirror.

In this embodiment, the projections of these electrode ends are formed linear at their tips, and the widths of the projections ea, ed on the wide angle portion side need to be larger than the widths of the opposing projections ec, eb on the narrow angle portion side. This is to allow uniform heating of the entire mirror surface by reducing the densities of currents flowing into the wide angle portions, which are easily heated. The ratios of the widths of the projections at the wide angle portions to the widths of the projections at the narrow angle portions vary depending on the size of the mirror, and on the material and size of the electrodes. It is preferable that the ratios are increased as the angles of the wide angle portions increase.

The heating of the mirror was controlled by a temperature control element (thermostat) 6. The surface temperature of the mirror base plate was able to be controlled in a range of 50–65° C. as set beforehand.

Embodiment 44

Figure 37:
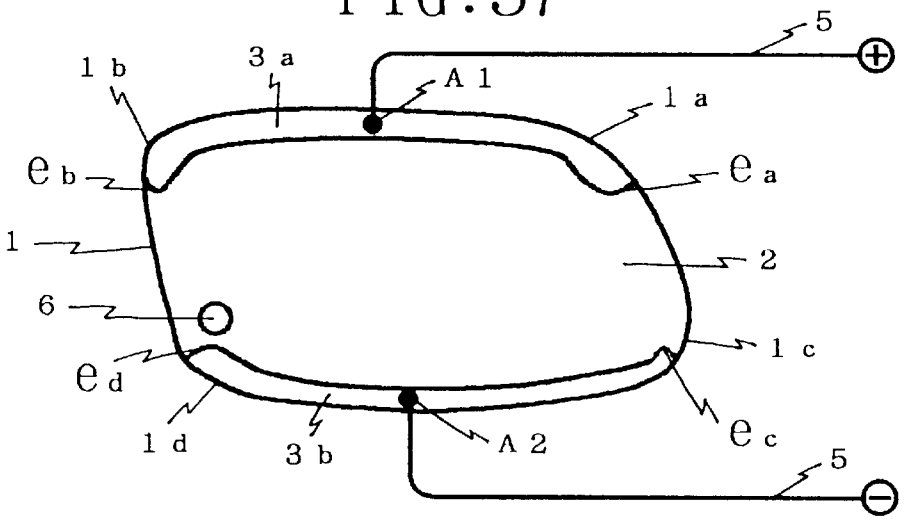
FIG. 37 is a rear view of a forty-fourth embodiment.

FIG. 37 shows a vehicle door mirror of Embodiment 44. The mirror with a heater of this embodiment was fabricated in the same way as of Embodiment 43, except that the projections were curved and that the radii of curvatures of the projections ea, ed on the wide angle portion sides were made larger than those of the projections ec, eb on the narrow angle portion sides.

The ratios of the radii of curvature of the projections at the wide angle portions to the radii of curvature of the projections at the narrow angle portions vary depending on the size of the mirror, and on the material and size of the electrodes. It is preferable that the ratios are increased as the angles of the wide angle portions increase.

The heating of the mirror was controlled by a temperature control element (thermostat) 6. The surface temperature of the mirror base plate was able to be controlled in a range of 50–65° C. as set in advance.

Embodiment 45

Figure 38:
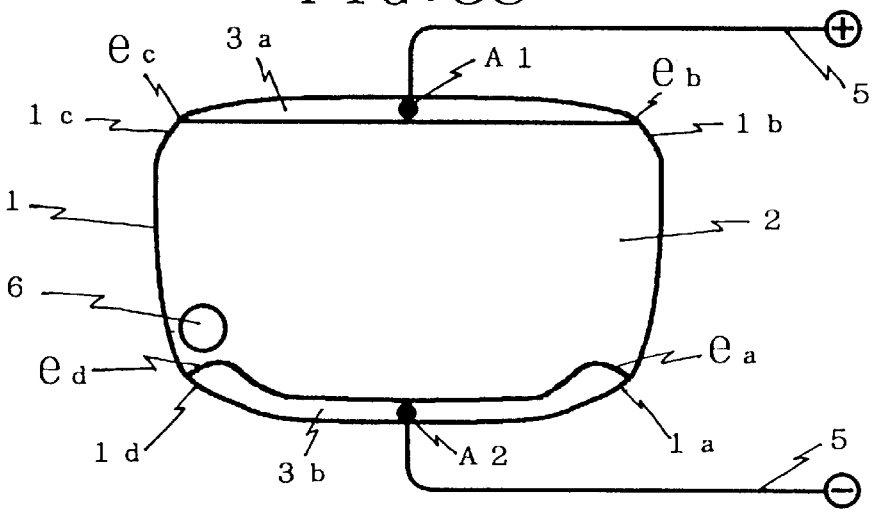
FIG. 38 is a rear view of a forty-fifth embodiment.

FIG. 38 shows a vehicle fender mirror of Embodiment 45. Titanium was deposited by sputtering on a generally trapezoidal, curved-surface glass mirror base plate 1 (R=1,000 mm) to a thickness of 0.1 μm to form a reflective heating resistor film 2.

Further, the back of the reflective heating resistor film 2 was provided with electrodes 3*a*, 3*b* to apply electricity to the film 2. The ends of the electrode 3*a* extend in both directions to the narrow angle portions 1*b*, 1*c* of the mirror base plate 1; and the ends of the electrode 3*b* extend in both directions to the wide angle portions 1*a*, 1*d*.

Current feeding points A1, A2 on the electrodes 3*a*, 3*b* were soldered with lead wires 5, thus fabricating a mirror with a heater mirror.

The electrode 3*b* was provided at the ends with curved projections so that the intervals between the electrodes were narrower near the short sides than at the central portion, thereby enabling the heating of the short side portions of the mirror base plate 1.

In the electrode 3*b*, reference symbol ea represents a projection at the electrode end on the wide angle portion 1*a* side of the mirror base plate 1, and reference symbol ed represents a projection at the electrode end on the wide angle portion 1*d* side. In the electrode 3*a*, eb, ec represent electrode end portions on the narrow angle portion sides facing the wide angle portion side projections ea, ed.

In this embodiment, these electrode ends are provided with projections on the wide angle portion sides and not provided with projections on the opposite narrow angle portion sides, so that the densities of currents flowing into the wide angle portions are reduced, allowing the entire surface of the mirror to be heated uniformly.

The heating of the mirror was controlled by a temperature control element (thermostat) 6. The surface temperature of the mirror base plate was able to be controlled in a range of 55–65° C. as designed.

Embodiment 46

Figure 39:
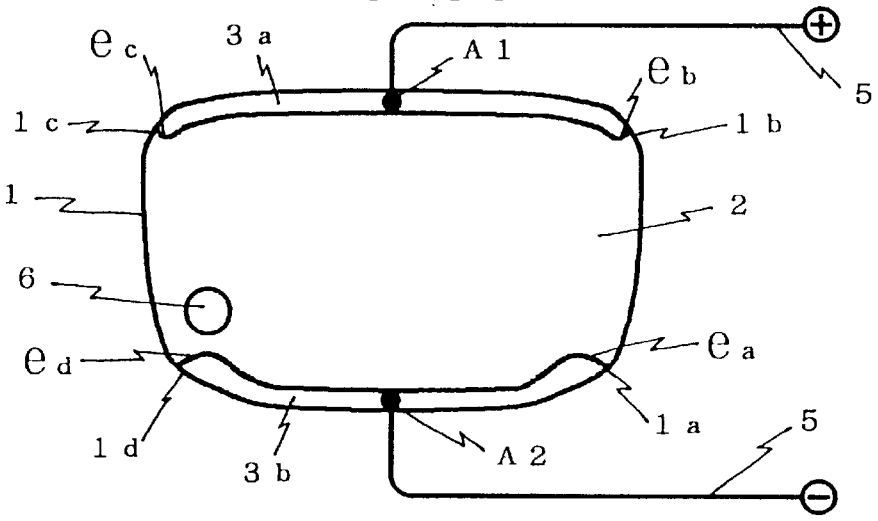
FIG. 39 is a rear view of a forty-sixth embodiment.

FIG. 39 shows a vehicle fender mirror of Embodiment 46. The mirror of this embodiment was fabricated in the same way as of Embodiment 45, except that the ends of the electrode 3*a* extending to the narrow angle portions 1*b*, 1*c* were provided with curved projections, and the radii of curvatures of wide angle portion side projections ea, ed were made larger than those of narrow angle portion side projections eb, ec that face the wide angle portion side projections ea, ed.

The heating of the mirror was controlled by a temperature control element (thermostat) 6. The surface temperature of the mirror base plate was able to be controlled in a range of 50–65° C. as set beforehand.

Embodiment 47

Figure 40:
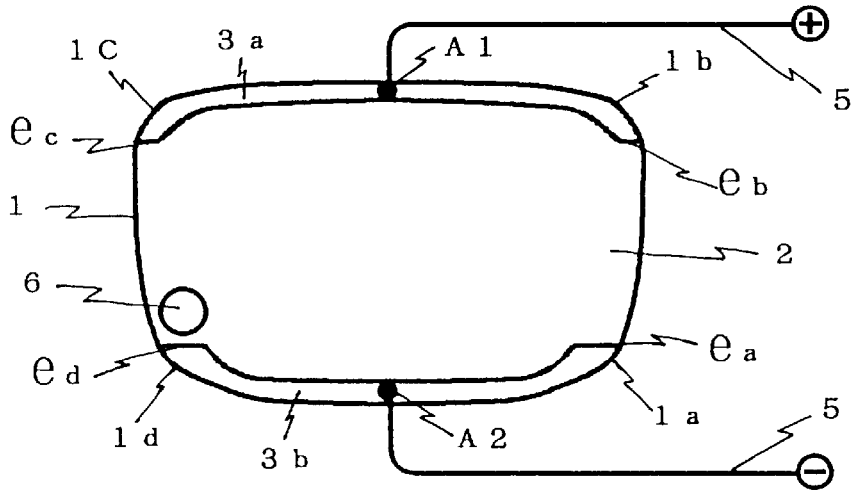
FIG. 40 is a rear view of a forty-seventh embodiment.

FIG. 40 shows a vehicle fender mirror of Embodiment 47. The mirror of this embodiment was fabricated in the same way as of Embodiment 45, except that the ends of the electrode 3*a* extending to the narrow angle portions 1*b*, 1*c* were provided with substantially linear projections eb, ec and the ends of the electrode 3*b* extending to the wide angle portions 1*a*, 1*d* were provided with substantially linear projections ea, ed, and the widths of the wide angle portion side projections were made larger than those of the narrow angle portion side projections.

The heating of the mirror was controlled by a temperature control element (thermostat) 6. The surface temperature of the mirror base plate was able to be controlled in a range of 50–65° C. as designed.

Embodiment 48

Figure 41:
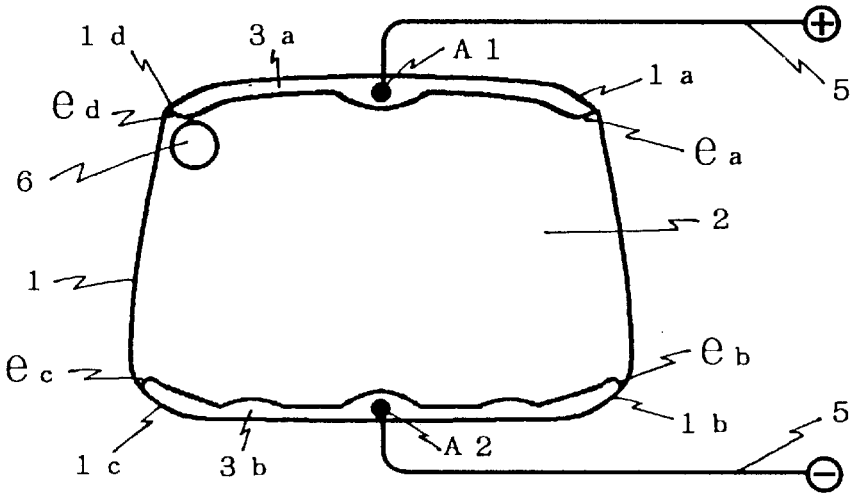
FIG. 41 is a rear view of a forty-eighth embodiment.

FIG. 41 shows a mirror of embodiment 48 for large-size automobiles. Nichrome and titanium were deposited by sputtering on a generally trapezoidal glass mirror base plate 1 (R=600 mm) to a thickness of 0.05 μm and 0.1 μm, respectively, to form a reflective heating resistor film 2.

Further, the back of the reflective heating resistor film 2 was provided with electrodes 3*a*, 3*b* to apply electricity to the film 2. The ends of the electrode 3*a* extended in both directions to the wide angle portions 1*a*, 1*d* of the mirror base plate 1; and the ends of the electrode 3*b* extended in both directions to the narrow angle portions 1*b*, 1*c*.

Current feeding points A1, A2 on the electrodes 3*a*, 3*b* were connected with lead wires 5, thus fabricating a mirror with a heater.

The opposing electrodes 3*a*, 3*b* were provided at the ends and at the center with projections; and the electrode 3*b* was further provided with projections, which were formed adjacent to the projections at the ends.

In the electrode 3*a*, reference symbol ea represents a projection at an electrode end on a wide angle portion 1*a* of the mirror base plate 1; and symbol ed represents a projection at the other electrode end on a wide angle portion 1*d*. In the electrode 3*b*, symbol eb represents a projection at an electrode end on a narrow angle portion 1*b* of the mirror base plate 1; and symbol ec represents a projection at the other electrode end on a narrow angle portion 1*c*.

In this embodiment, these projections are curved, and the distances from the electrode ends to the vertexes of the projections ea, ed on the wide angle portion sides than those of the opposite projections eb, ec on the narrow angle portion sides, so that the densities of currents flowing into the wide angle portions are reduced, permitting the uniform heating of the entire surface of the mirror.

The heating of the mirror was controlled by a temperature control element (thermostat) 6. The surface temperature of the mirror base plate was able to be controlled in a range of 50–65° C. according to the setting.

Because the mirror size in this embodiment is large, projections are formed not only at the ends of the electrodes but also at the central part to enable uniform heating of the mirror.

Embodiment 49

Figure 42:
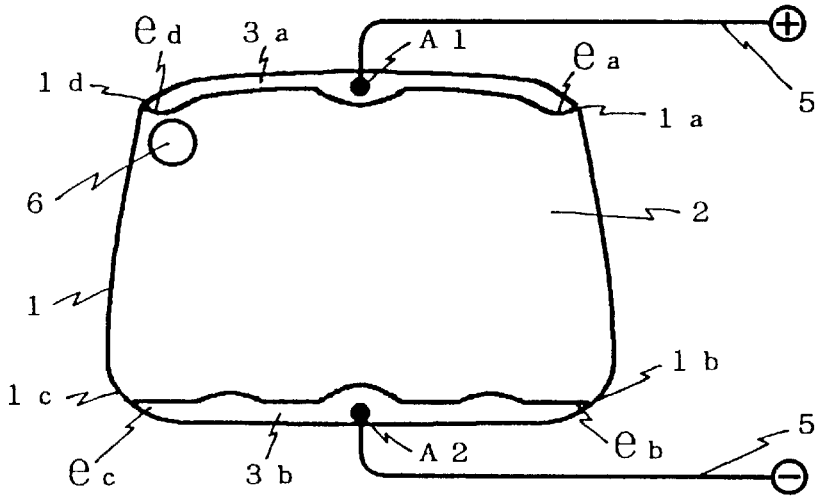
FIG. 42 is a rear view of a forty-ninth embodiment.

FIG. 42 shows a mirror for large-size automobiles of Embodiment 49. A mirror with a heater of this embodiment was fabricated in the same way as of Embodiment 48, except that the ends of the electrode 3*b* extending in both directions to the narrow angle portions 1*b*, 1*c* were not formed with projections.

The heating of the mirror was controlled by a temperature control element (thermostat) 6. Although the temperatures of the left and right sides were slightly low, the surface temperature of the mirror base plate was able to be controlled in a range of 45–65° C. as designed.

Embodiment 50

Figure 43:
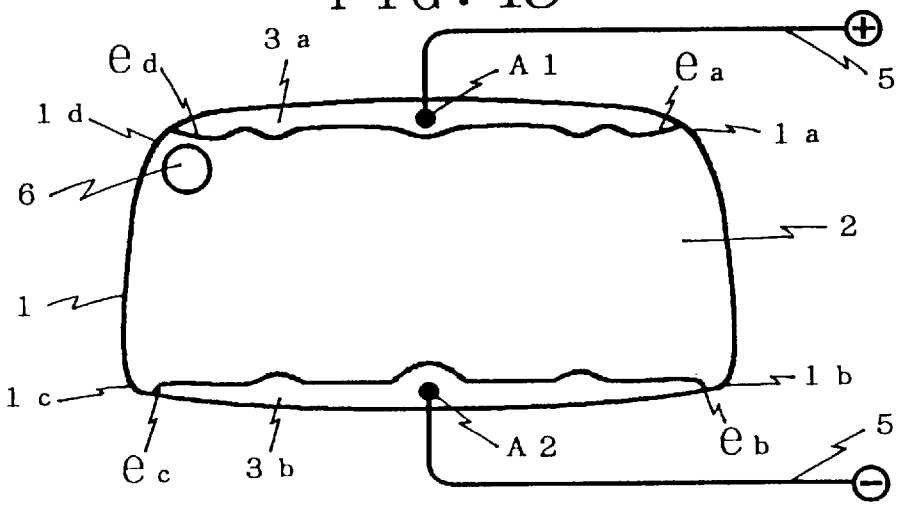
FIG. 43 is a rear view of a fiftieth embodiment.

FIG. 43 shows a mirror for large-size automobiles of embodiment 50. Nichrome and titanium were deposited by sputtering on a generally trapezoidal curved surface glass mirror base plate 1 (R=600 mm) to a thickness of 0.05 μm and 0.1 μm, respectively, to form a reflective heating resistor film 2.

Further, the back of the reflective heating resistor film 2 was provided with electrodes 3 made up of electrodes 3*a*, 3*b* to apply electricity to the film 2. The ends of the electrode 3*a* extend in both directions to the wide angle portions 1*a*, 1*d* of the mirror base plate 1; and the electrode 3*b* was so formed that its ends were located slightly inside from the narrow angle portions 1*b*, 1*c*.

Current feeding points A1, A2 on the electrodes 3*a*, 3*b* were connected with lead wires 5, thus fabricating a mirror with a heater.

The electrode 3*a* was formed at the ends and the center with projections and also with other projections adjacent to the end projections. The other electrode 3*b* was formed with projections that correspond to the projection at the center of the electrode 3*a* and to the projections adjacent to the end projections of the electrode 3*a*.

In the electrode 3*a*, reference symbol ea represents a projection at an electrode end on the wide angle portion 1*a* side of the mirror base plate 1, and reference symbol ed represents a projection at the other electrode end on the wide angle portion 1*d* side. In the electrode 3*b*, symbols eb, ec represent electrode end portions facing the wide angle portion side projections ea, ed.

In this embodiment, these electrode ends were provided with projections at the ends on the wide angle portion sides and not with projections at the ends on the opposite narrow angle portion sides, so that the densities of currents flowing into the wide angle portions were reduced allowing the entire surface of the mirror to be heated uniformly.

The heating of the heater-incorporated mirror was controlled by a temperature control element (thermostat) 6. The surface temperature of the mirror base plate was able to be controlled in a range of 50–65° C. as set beforehand.

Embodiment 51

Figure 44:
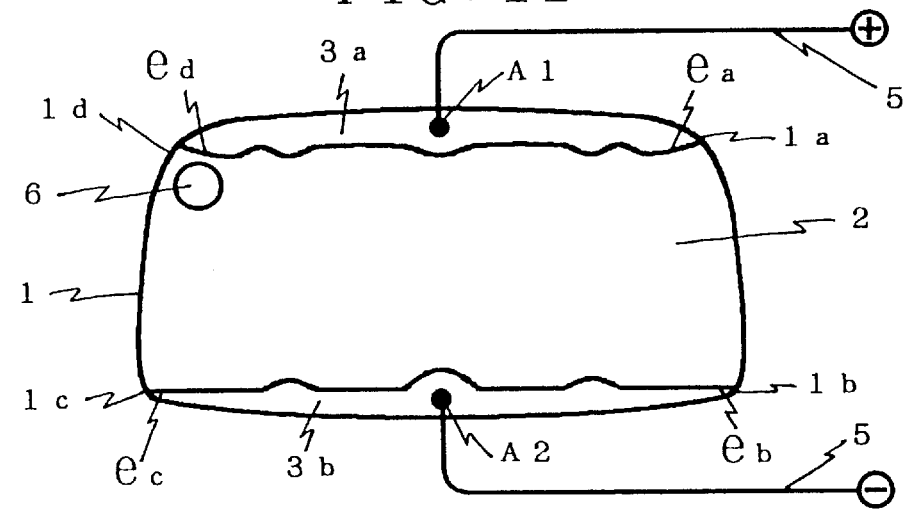
FIG. 44 is a rear view of a fifty-first embodiment.

FIG. 44 shows a mirror for large-size automobiles of Embodiment 51. The mirror with a heater of this embodiment was fabricated in the same way as of Embodiment 50, except that the electrode 3*b* extended in both directions to the narrow angle portions 1*b*, 1*c*.

The heating of the mirror was controlled by a temperature control element (thermostat) 6. The surface temperature of the mirror base plate was able to be controlled in a range of 50–65° C. as set in advance.

Embodiment 52

Figure 45:
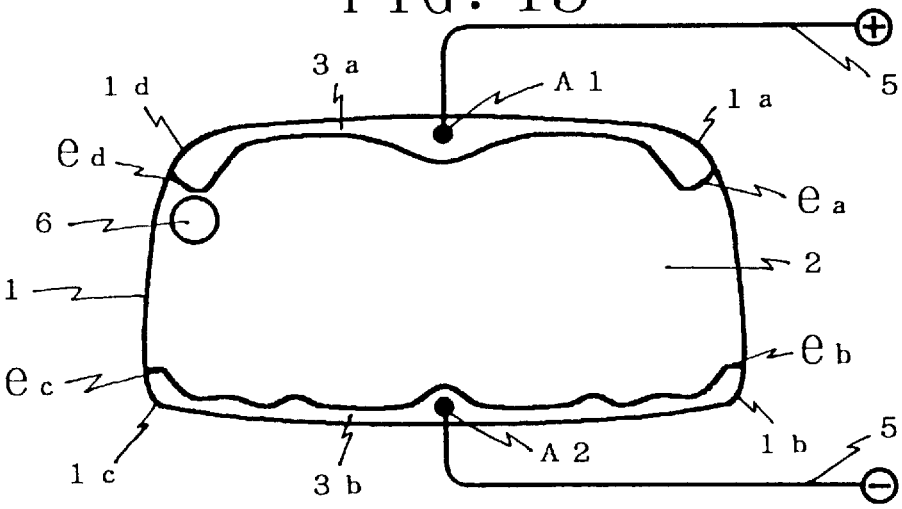
FIG. 45 is a rear view of a fifty-second embodiment.

FIG. 45 shows a mirror for large-size automobiles of embodiment 52. The mirror with a heater of this embodiment was fabricated in the same way as of Embodiment 50, except that an electrode 3*a* was provided with projections at the center and the ends and an electrode 3*b* was provided with projections at the center and the ends and also at a plurality of locations, and the distances from the ends to the vertexes of the curved projections ea, ed on the wide angle portion sides were made larger than the widths of the linear projections eb, ec on the opposite narrow angle portion sides.

The heating of the mirror was controlled by a temperature control element (thermostat) 6. The surface temperature of the mirror base plate was able to be controlled in a range of 50–65° C. as designed.

The preceding embodiments 53 to 59 are examples in which a temperature detection element is provided near an electrode end on the wide angle portion side of opposing electrode to realize easy temperature control of a portion that is easily overheated in the conventional mirrors, and in which the easily overheated portion is given an increased heat capacity to substantially suppress the temperature rise speed of the portion so that appropriate heating of the narrow angle portion, which has been difficult to heat, will not result in an excessive temperature rise of the wide angle portion, thereby ensuring efficient uniform heating of the entire surface of the mirror base plate.

Embodiment 53

Figure 46:
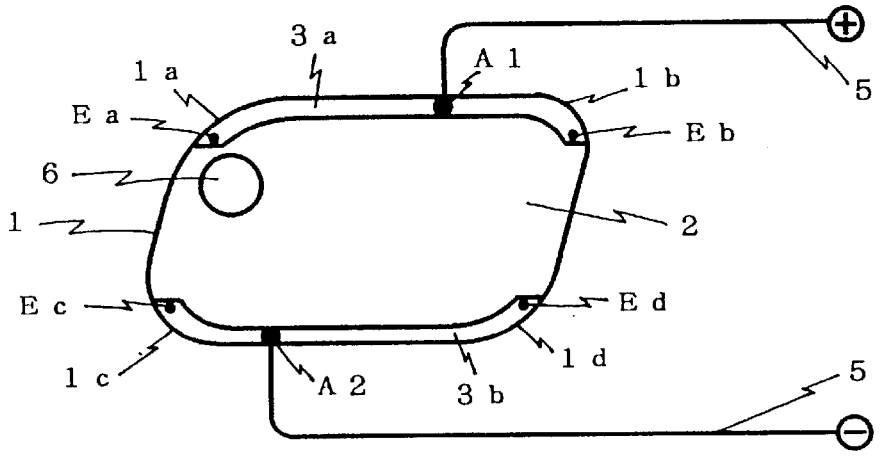
FIG. 46 is a schematic perspective view showing the back of a fifty-third embodiment.

In the vehicle door mirror shown in FIG. 46, titanium was deposited by sputtering over a glass mirror base plate 1 to a thickness of 0.08 μm to form a reflective heating resistor film 2, on which a copper paste was applied by screen-printing to form a thin copper layer as electrodes 3*a*, 3*b* with an even resistance distribution. A temperature detection element 6 of thermostat was installed near an electrode end Ea on the wide angle portion side of the opposing electrodes. Current feeding points A1, A2 located on the narrow angle portions 1*b*, 1*c* sides from the centers of the electrodes 3*a*, 3*b* were connected with lead wires 5. In this way, a mirror with a heater was fabricated. When a DC voltage of 12 V was applied between the feeding points A1 and A2, a current of 3.6 A flowed.

The heating of the mirror was controlled by the temperature detection element 6 of thermostat. The temperature of the mirror surface was able to be controlled in a range of 50–65° C. as set in advance.

In this embodiment, the electrode ends on the wide angle portion sides of the opposing electrodes are denoted by Ea and Ed. Although the temperature detection element 6 may be installed near either electrode end Ea or Ed on the wide angle portion sides, it is preferably placed on the wider angle portion side. It is also possible to use a temperature detection element 6 out of contact with the mirror surface. For example, a temperature detection element 6 comprising an infrared light receiving element may be attached to the mirror holder and the surface of the heating resistor film 2 close to the electrode end Ea or Ed on the wide angle portion side of the base plate with respect to the current feeding point A1 or A2 may be made an infrared ray monitoring portion. In this way the temperature control may be performed.

Embodiment 54

Figure 47:
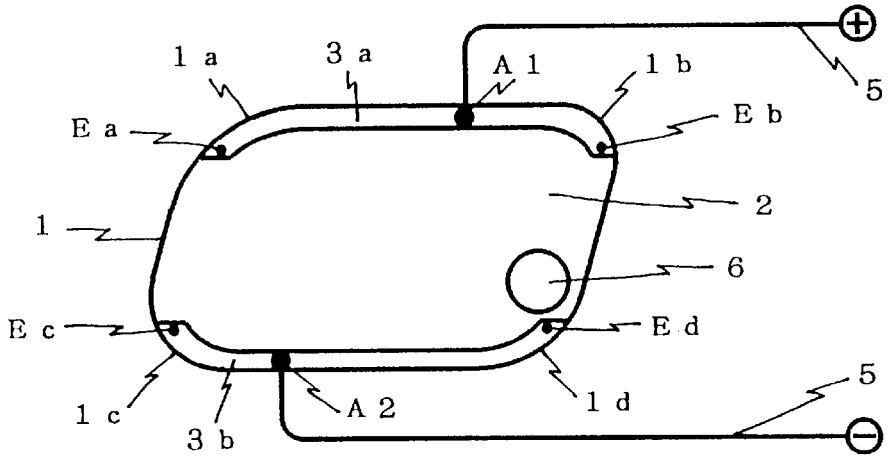
FIG. 47 is a schematic perspective view showing the back of a fifty-fourth embodiment.

A mirror with a heater of this embodiment was fabricated in the same way as in Embodiment 53, except that a temperature detection element 6 of thermostat was installed near the other electrode end Ed on the wide angle portion side (See FIG. 47).

As in Embodiment 53, the temperature of the entire surface of the mirror base plate was able to be controlled in a range of 50–65° C. as designed.

Embodiment 55

Figure 48:
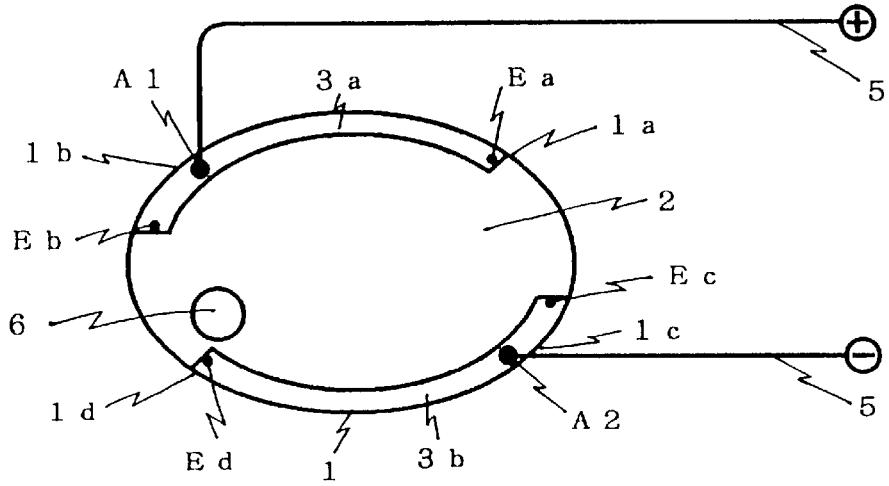
FIG. 48 is a schematic perspective view showing the back of a fifty-fifth embodiment.

In a vehicle door mirror shown in FIG. 48, nichrome and titanium were deposited by sputtering over a generally oval glass mirror base plate 1 to a thickness of 0.05 μm each to form a reflective heating resistor film 2, on which silver and copper pastes were applied by screen-printing to form a two-layer thin film of silver and copper as opposing electrodes 3*a*, 3*b*. A temperature detection element 6 of thermister was installed near an electrode end Ed on the wide angle portion side of the opposing electrodes. Current feeding points A1, A2 located on the narrow angle portions 1*b*, 1*c* sides from the centers of the electrodes 3*a*, 3*b* were connected with lead wires 5. In this way, a mirror with a heater was fabricated. When a DC voltage of 12 V was applied between the feeding points A1 and A2, a current of 2.5 A flowed.

The heating of the mirror was controlled by a temperature detection element 6 of thermister. The temperature of the entire mirror surface was able to be controlled in a range of 50–65° C. as designed.

Embodiment 56

Figure 49:
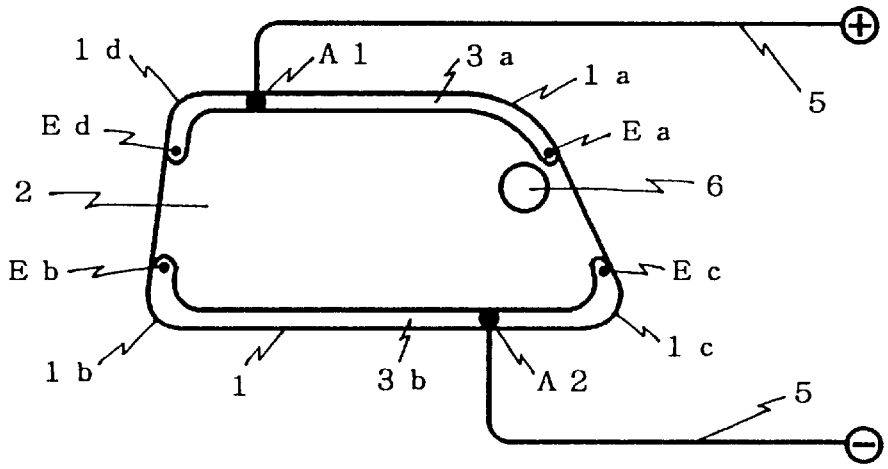
FIG. 49 is a schematic perspective view showing the back of fifty-sixth and fifty-seventh embodiments.

In a vehicle door mirror shown in FIG. 49, titanium was deposited by sputtering over a generally trapezoidal glass mirror base plate 1 to a thickness of 0.1 μm to form a reflective heating resistor film 2, on which silver and copper pastes were applied by screen-printing to form a two-layer thin film of silver and copper as opposing electrodes 3*a*, 3*b* with a uniform resistance distribution. A temperature detection element 6 of thermostat was installed near an electrode end Ed on the wide angle portion side of the opposing electrodes. Current feeding points A1, A2 located on the narrow angle portions 1*b*, 1*c* sides from the centers of the electrodes 3*a*, 3*b* were connected with lead wires 5. In this way, a mirror with a heater was fabricated. When a DC voltage of 12 V was applied between the feeding points A1 and A2, a current of 4.5 A flowed.

The heating of the heater-incorporated mirror was controlled by the temperature detection element 6 of thermostat. The temperature of the entire mirror surface was able to be controlled in a range of 50–60° C. as set beforehand.

Embodiment 57

A mirror with a heater of this embodiment was fabricated in the same way as in Embodiment 56, except that a temperature detection element 6 of thermostat was installed near the other electrode end Ed on the wide angle portion side of the opposing electrodes.

As in Embodiment 56, the temperature of the entire surface of the mirror base plate was able to be controlled in a range of 50–65° C. as designed.

Embodiment 58

Figure 50:
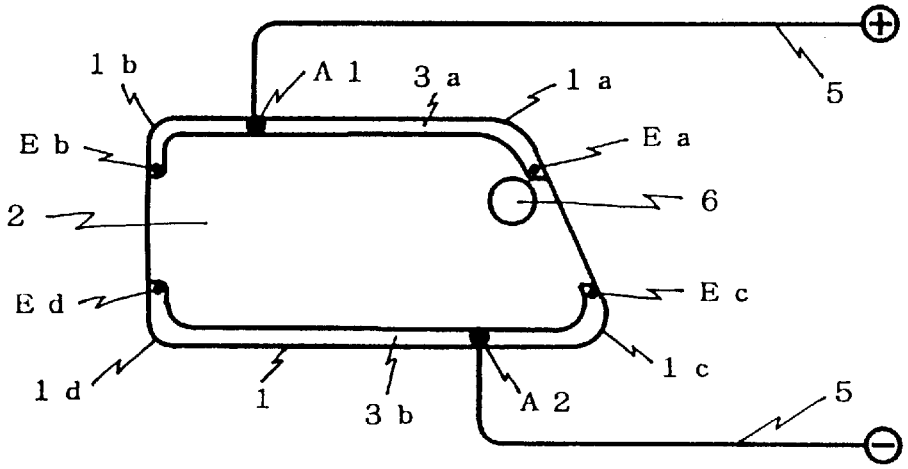
FIG. 50 is a schematic perspective view showing the back of a fifty-eighth embodiment.

In a vehicle door mirror shown in FIG. 50, titanium was deposited by sputtering over a glass mirror base plate 1 of generally trapezoidal shape with an inclined leg on only one side to a thickness of 0.1 μm to form a reflective heating resistor film 2, on which silver and copper pastes were applied by screen-printing to form a two-layer thin film of silver and copper as opposing electrodes 3*a*, 3*b* with a uniform resistance distribution. A temperature detection element 6 of thermostat was installed near an electrode end Ea on the wide angle portion side of the opposing electrodes. Current feeding points A1, A2 located on the narrow angle portions 1*b*, 1*c* sides from the centers of the electrodes 3*a*, 3*b* were connected with lead wires 5. In this way, a mirror with a heater was fabricated. When a DC voltage of 12 V was applied between the feeding points A1 and A2, a current of 4.3 A flowed.

The heating of the mirror was controlled by the temperature detection element 6 of thermostat. The temperature of the entire mirror surface was able to be controlled in a range of 50–60° C. as set beforehand.

Embodiment 59

Figure 51:
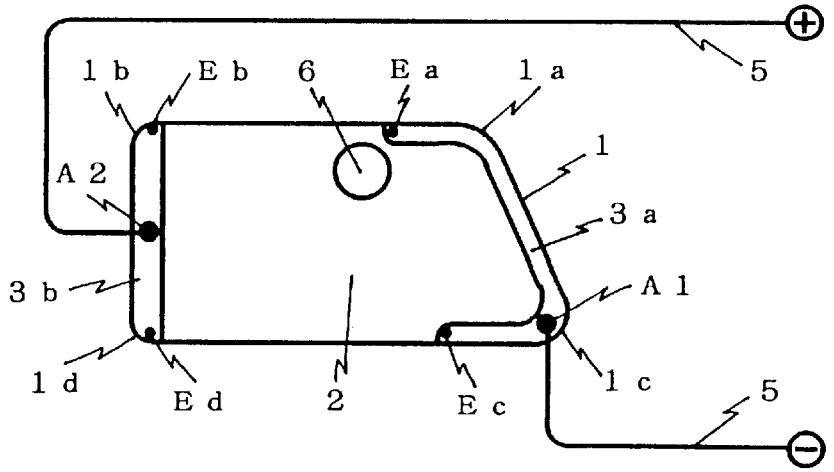
FIG. 51 is a schematic perspective view showing the back of a fifty-ninth embodiment.

In a vehicle door mirror shown in FIG. 51, titanium was deposited by sputtering over the glass mirror base plate 1 of generally trapezoidal shape with an inclined leg on only one side to a thickness of 0.1 μm to form a reflective heating resistor film 2. Silver and copper pastes were applied by screen-printing along the inclined leg and the opposite leg of the mirror base plate 1 to form a two-layer thin film of silver and copper as electrodes 3 with a uniform resistance distribution. A temperature detection element 6 of thermostat was installed near an electrode end Ea on the side angle portion side of the opposing electrode. A current feeding point A1 was located on the narrow angle portion 1*c* side of an electrode 3*a* from the center of the electrode 3*a* and another current feeding point A2 was located at the center of an electrode 3*b* (potentially middle point; the voltage drop between A2 and Eb was equal to that between A2 and Ed). These feeding points A1, A2 were connected with lead wires 5 to fabricate a mirror with a heater. When a DC voltage of 12 V was applied between the feeding points A1 and A2, a current of 3.1 A flowed.

The heating of the heater-incorporated mirror was controlled by the temperature detection element 6 of thermostat. The temperature of the mirror surface including the areas of the narrow angle portions of the base plate was able to be controlled in a range of 50–65° C. as set in advance.

What is claimed is:

1. A mirror with a heater comprising:

a mirror base plate;

a reflective film disposed directly on the mirror base plate for providing a reflective surface on the mirror base plate;

a heating resistor film consisting essentially of titanium disposed on the reflective film for uniformly heating the reflective surface of the reflective film; and at least one pair of opposing electrodes disposed on the heating resistor film for applying electricity to the heating resistor film to heat the reflective surface of the reflective film.

2. A mirror with a heater according to claim 1; wherein the reflective film has a thickness of 0.05–0.15 μm.

3. A mirror with a heater according to claim 2; wherein the reflective film has a thickness of 0.1 μm.

4. A mirror with a heater according to claim 1; further comprising a temperature control element for controlling the temperature applied on the heating resistor film.

5. A mirror with a heater comprising: a mirror base plate; a reflective film disposed directly on the mirror base plate; a heating resistor film consisting essentially of titanium disposed on the reflective film; and at least one pair of opposing electrodes disposed on the heating resistor film to apply electricity to and heat the heating resistor film, the distance between the electrodes near corner portions of the mirror base plate being smaller than the distance between the electrodes at a central portion of the mirror base plate.

6. A mirror with a heater according to claim 5; wherein the mirror base plate has a first side edge and a second side edge, the distance between the electrodes at the first side edge being smaller than the distance between the electrodes at the second side edge.

7. A mirror with a heater according to claim 5; wherein the electrodes extend along opposed longitudinal edges of the mirror base plate; and wherein the mirror base plate has a first side edge portion and a second side edge portion disposed between the longitudinal edges, the distance between the electrodes at the first side edge portion being smaller than the distance between the electrodes at the second side edge portion.

* * * * *